United States Patent [19]

Abbott

[11] 4,055,264

[45] Oct. 25, 1977

[54] DECK SECTION LOADING

[75] Inventor: Phillip Andrew Abbott, Houston, Tex.

[73] Assignee: Brown & Root, Inc., Houston, Tex.

[21] Appl. No.: 601,661

[22] Filed: Aug. 4, 1975

[51] Int. Cl.[2] ..... B63B 35/42; B65G 67/58

[52] U.S. Cl. ..... 214/152; 61/67; 114/265; 214/1 BE; 214/14

[58] Field of Search ..... 214/152, 1 BE, 12, 13, 214/14, 15 R; 114/264, 265, 75; 61/86–104, 67; 254/93 R, 93 HP

[56] References Cited

U.S. PATENT DOCUMENTS

| | | | |
|---|---|---|---|
| 2,395,423 | 2/1946 | O'Laughlin | 61/67 |
| 2,714,011 | 7/1955 | Albee | 254/93 HP |
| 3,054,267 | 9/1962 | Alcorn et al. | 61/46.5 |
| 3,478,526 | 11/1969 | Foster | 61/67 |
| 3,496,897 | 2/1970 | Pogonowski et al. | 114/.5 D |
| 3,612,484 | 10/1971 | Gallagher | 254/93 HP |
| 3,776,169 | 12/1973 | Strecker | 114/75 |
| 3,790,009 | 2/1974 | Hauber | 214/152 |
| 3,811,583 | 5/1974 | Weeks | 214/152 |

*Primary Examiner*—Trygve M. Blix

*Assistant Examiner*—Stuart M. Goldstein

*Attorney, Agent, or Firm*—Murray Robinson; Hubert E. Cox, Jr.

[57] ABSTRACT

An elongated deck section having two rows of legs with several legs per row is fabricated with the legs hingedly mounted on footings adapted to receive fluid bearings and is transported from the fabricating yard to a dock head over a smooth concrete slab of minimal slope and thence longitudinally via fluid bearing adapted gang planks and tracks onto and along a barge disposed with its stern adjacent the dock head and grounded thereat, the platform being transported by placing fluid bearings under the footings which allow the section to be moved sideways, lengthways, or rotated or turned, as desired, the deck's horizontal truss stresses and the fluid bearing loads being controlled by actuating fluid elevators between each leg and the fluid bearing thereunder, the barge being initially ballasted so that change of ballast during loading is unnecessary to maintain minimal slope of the barge, the section then being anchored to the barge and the barge reballasted to float its stern and trim the barge preparatory to towing it to sea for installation of the deck section on an offshore tower as part of an offshore platform.

20 Claims, 27 Drawing Figures

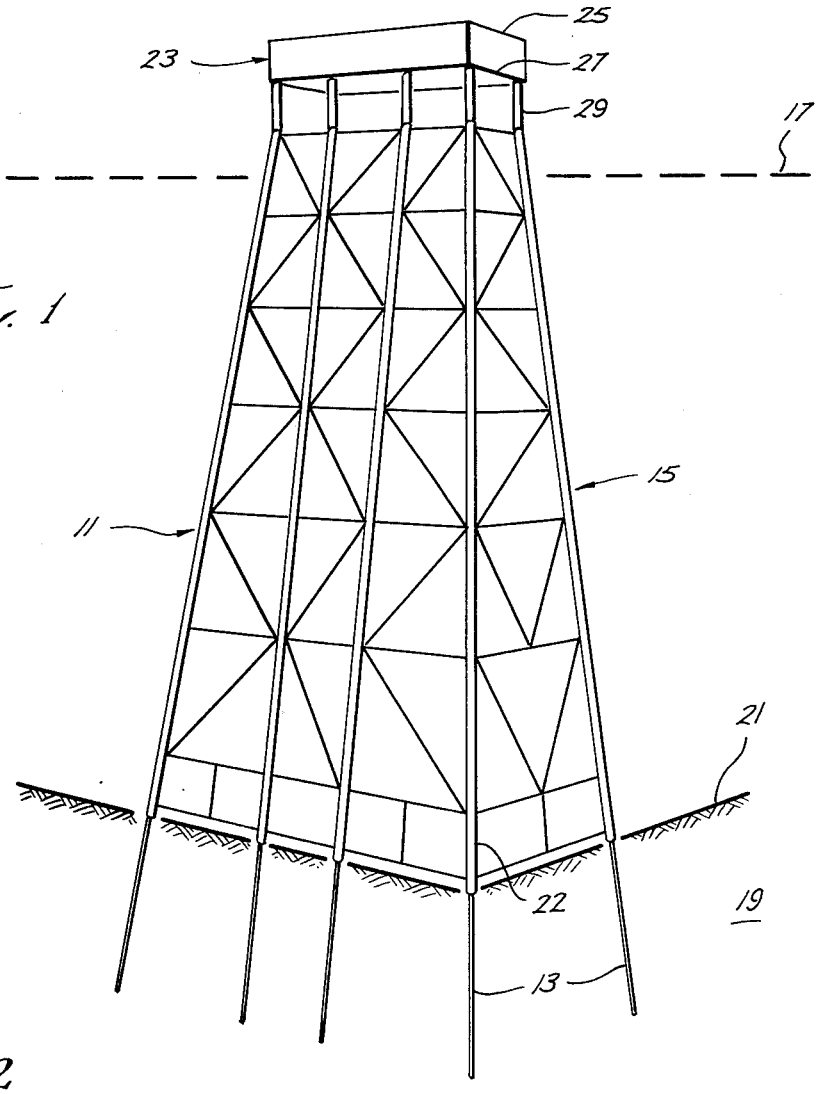
Fig. 1
Fig. 2
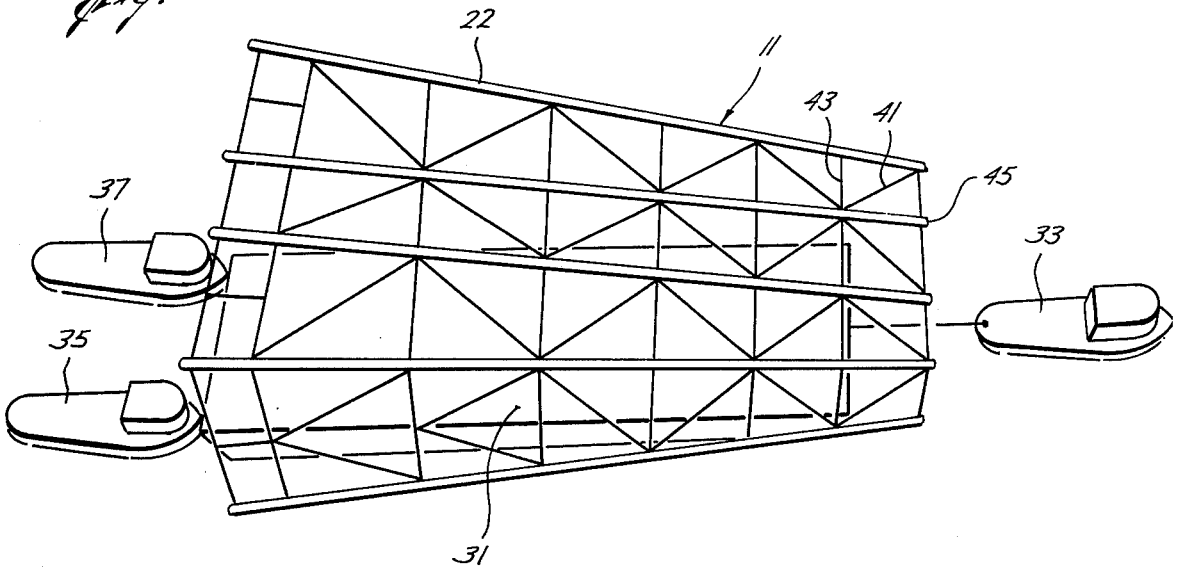

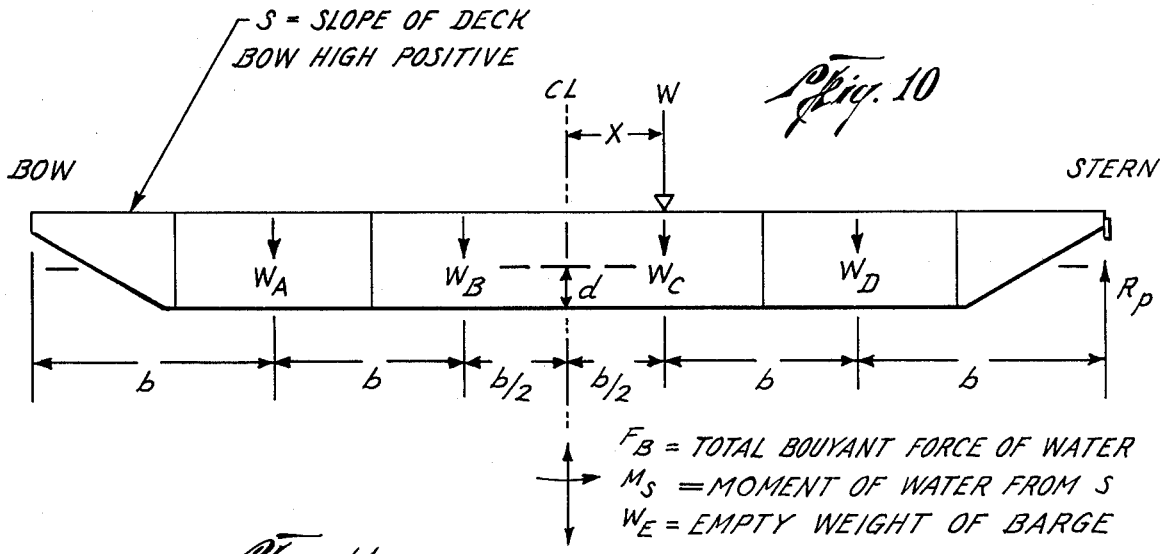
Fig. 10
Fig. 11
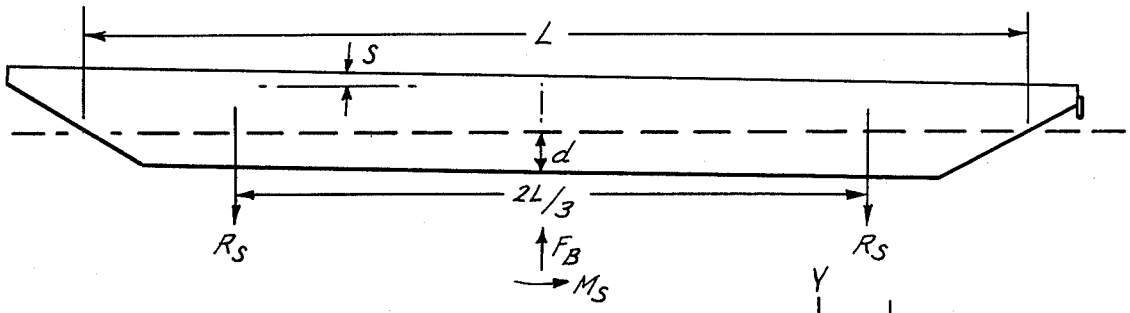
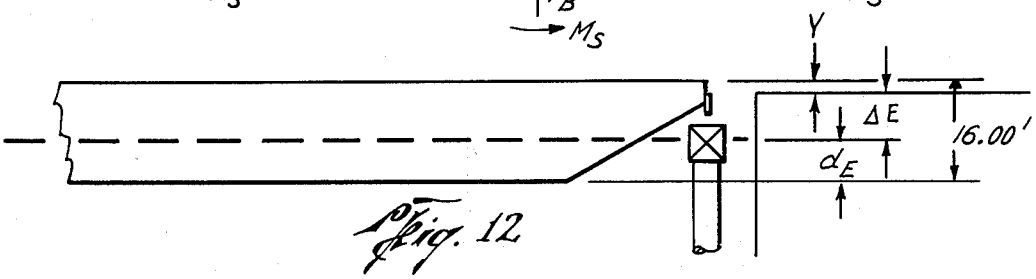
Fig. 12
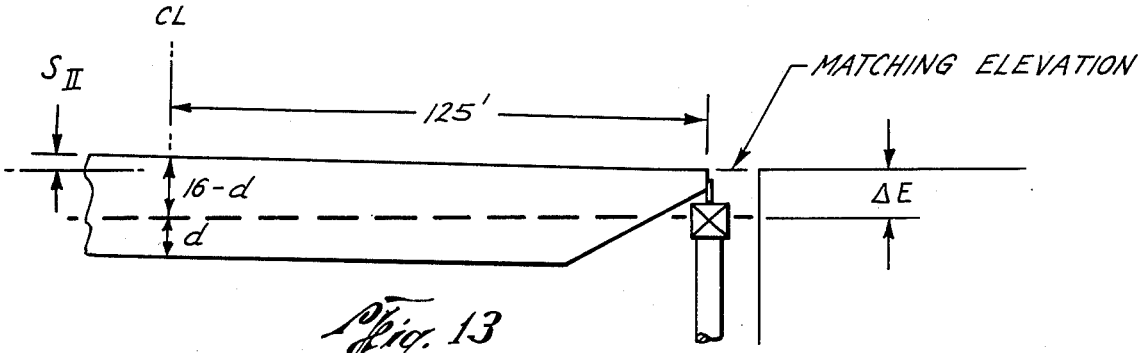
Fig. 13

Fig. 15
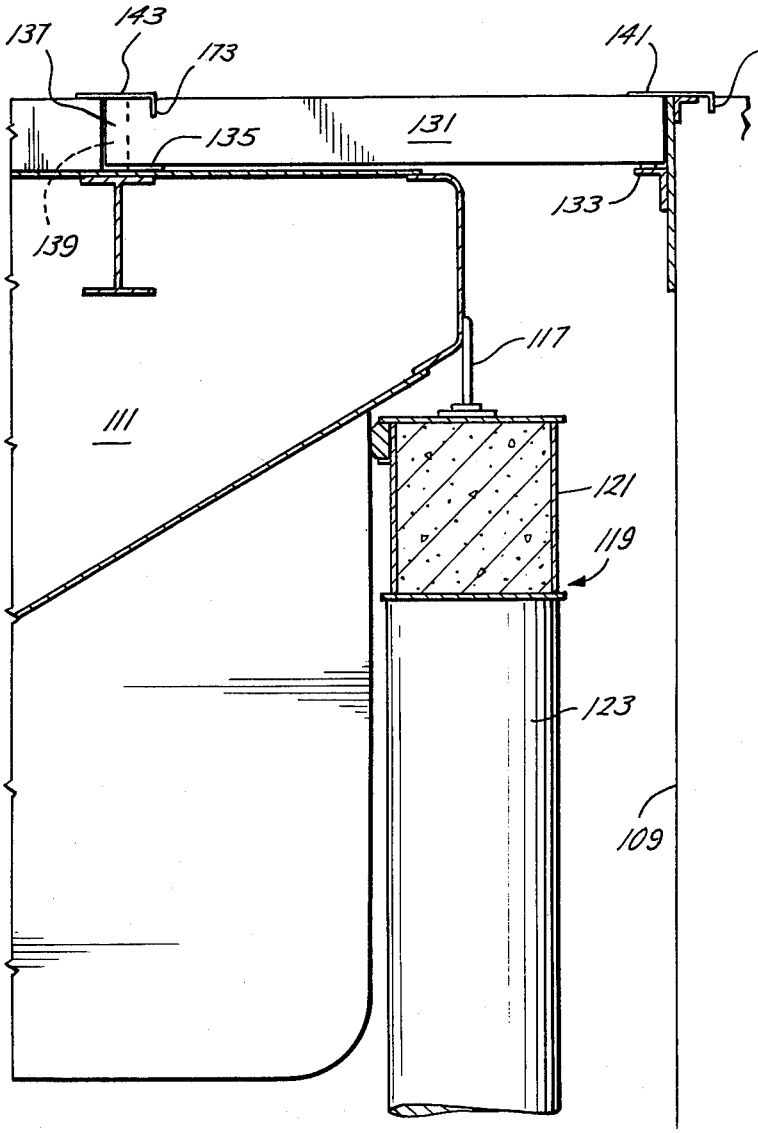
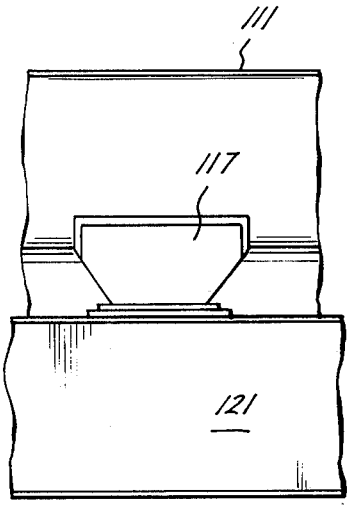
Fig. 16

DECK SECTION LOADING

BACKGROUND OF THE INVENTION:

This invention pertains to a method of transportation and more particularly to a method of transporting a deck section for an offshore platform from the fabrication area to a seagoing barge.

At its Greens Bayou yard the Western Hemisphere Marine Cosntruction division of Brown & Root, Inc., has for a number of years constructed both deck sections and jacket templates for offshore platforms. An early form of platform construction is shown in U.S. Pat. No. 2,653,451 to S. E. McCullough assigned to Brown and Root, Inc.

A jacket template, or more simply a jacket as it is usually called, comprises a plurality of pipes with slight batter assembled together with cross bracing. A jacket is lowered to rest on the sea floor. Piling is driven through the pipes into the floor. Sometimes the pipes are then filled with cement grout. There is thus constructed an offshore tower. One or more such towers are used to support the legs of an above water deck composed of one or more sections. Usually there is one deck section per tower although sometimes there may be more than one section per tower, for thesize of the deck section is limited by the elevating capacity of the marine derrick barge, while the jackets need not be lifted completely off the barge to be launched and hence are not limited in size by derrick barge capacity.

A deck section typically comprises an elongated deck, e.g. rectangular, with legs extending down below the deck, the legs being disposed in two rows extending longitudinally of the deck, one row adjacent each side of the deck, there being several (more than two) legs in each row. It is to the transporation of this type of deck section to which the present invention is particularly directed although in its broader aspects the invention is also applicable to deck sections of any shape, e.g. deck sections with square decks supported on four legs.

Jackets have been fabricated lying on their sides. A jacket is moved from the fabricating yard to a barge by sliding it lengthwise over skids onto the end of an elongated barge which is disposed with one end grounded to the dock head.

Deck sections have been fabricated in erect position with their lengths parallel to the dock head and slid laterally on skids onto an elongated barge lying with its length parallel to the deck section. Such lateral loading has usually been thought to be desirable in order to avoid undue stress on the deck section when it was disposed half on the barge and half on the dock. With one row of legs on the barge and one on the dock, load is evenly distributed even if the barge rises or falls relative to the dock head. If endwise loading is attempted, uneven loading can occur with, for example, one leg of each row on the barge and three legs on the dock, should the barge rise or fall. It is believed that in the past endwise loading of a deck section onto a barge required calm water and change of ballasting of the barge during loading to avoid the danger of destructive loads being imposed on the deck section. However, lateral loading of the deck section on the barge is also difficult and dangerous due to the need for ballasting the barge to maintain lateral stability during loading. A small error in ballasting can cause the barge to roll over sideways. The time consumed for such an operation has been several hours.

To give a better idea of the problem involved, it may be noted that a typical deck section may be 180 feet long by 85 feet wide and weight over a thousand tons. The top deck may be close to 60 feet above ground with the unbraced legs extending forty feet down from the lower deck. Each leg is a pipe several feet in diameter with a conical stabing point at its lower end to be set in a socket on top of an offshore tower.

In about 1973 Brown and Root, Inc. commenced a yard improvement program. The present invention arose as part of that program.

SUMMARY OF THE INVENTION

According to the invention an elongated deck section having vertical legs disposed in two rows extending lengthwise of the barge with usually several legs in each row is fabricated with the legs mounted on footings, preferably hinged, adapted to receive fluid bearings. The fabrication is effected on a smooth concrete slab reinforced to receive the concentrated loads of fluid bearings. An elongated barge provided with a pair of fluid bearing tracks is moved into position with one end adjacent the dock head and ballasted to ground one end on a below dock level rest, the other end being higher. A pair of gang planks providing fluid bearing track sections are lowered into position between the dock head and the barge tracks, being sealed to the dock head and the barge tracks to provide paths for the fluid bearings. Fluid bearings with elevators thereon are disposed under each footing of the deck section legs. The deck section is floated on the fluid bearings and moved over the slab into a position with its length aligned with that of the barge. The deck section is moved over the gang planks and the tracks on the barge until it is disposed wholly on the barge. The elevators may be adjusted as the deck section is moved to compensate for change and differences in the elevation of the slab, gang planks, and barge track. When the deck section is wholly on the barge, the fluid bearings and elevators are deactivated, bringing the footings to rest on the tracks on the barge. The bearings are removed, the gang planks are removed, the ballast is changed to float the previously grounded end of the barge and to level the barge, the deck section is secured to the barge, and the barge is taken to the offshore location and the footings are cut off the deck section.

The procedure is then continued as in the previously used method, the section being lifted with a marine crane and placed on the already constructed tower and secured thereto.

When the barge is returned to the fabrication yard, the previously used footings may be employed for mounting the legs of another deck section for fluid bearing transportation.

Due to the initial ballasting of the barge with the floating end slightly higher than the grounded end, the barge levels out as the deck section is loaded onto the barge and no ballast changes are required during loading. The whole movement from slab to barge takes less than an hour. The elevation adjustment at each leg during the loading of the deck section from the slab to the barge not only maintains the fluid bearings in effective spaced proximity of the slab, gang planks and track surfaces to avoid ground outs and blow outs but also effects desired load distribution amongst the several legs. The ballasting is such that the slope of the barge tracks is compatible with the elevating range of the elevators and bearings during loading.

In carrying out the above described method Brown and Root, Inc. contacted several suppliers of fluid bearings. The fluid used may be either compressed air or water. Fluid bearings with fluid elevators mounted thereon are offered by Air Barge Company of Palos Verdes, Calif., being described in their printed brochure which indicates that their product is disclosed in U.S. and foreign patents. This concern made a proposal to Brown and Root in February of 1974.

Another fluid bearing supplier, Rolair Systems, Inc. distributed information on preparation of pathways for fluid bearings, including preparation and finishing of the surfaces of large concrete areas and the filling and sealing of joints. This concern made a proposal to Brown and Root in January of 1974.

Fluid bearings with elevators are also offered by Aero-Go Company of Seattle, Washington, their product also being described in issued, pending and to be filed patents and applications. This concern made a proposal to Brown and Root in March of 1974.

Fluid bearings easily carry heavy loads. Water bearings have previously been used to move ship sections about a shipyard and move assembled sections to ship launchways.

Fluid bearings made by Rolair and Airfloat Corporation and those made by Aero-Go Inc. and their use are described in the October 1973 issue of Material Handling Engineering in an article entitled "No More Wait and See for Air film Handling."

Other publications relative to fluid bearings are articles in Boeing News, May 1972 - "Aero-Go Goes as Air Flows" mentioning also Aero-Jacks; in Time, Nov. 22, 1968 - "Technology"; Scientific American, April 1969 - "How To Lift A Giant With 20 p.s.i."; Transportation Engineer, February, 1973, p.16 et seq.- "Meyer Riggins's air-casters float giant engine into place"; Elastomers Notebook by DuPont, p.248; Marine Digest, November 1973 - "Aero-Caster Water Bearings Used at Todd Yard."

Brown and Root, Inc's Marine Division employed Austin Research Engineers, Inc. to recommend a slab design. They reported in November 1973. Brown and Root, Inc. employed McClure and Associates of Houston, Texas to make a feasibility study of the subject method, and they reported in 1974. Brown and Root, Inc. employed L. B. Christianson Engineers, Inc., to assist in the structural design of various components of equipment used in carrying out the method, in particular water pump and filter units to supply the water bearings, and the gang planks between the barge and dock head. Reink De Boer of Brown & Root's central engineering department also contributed to the design of various structures used in carrying out the method, in particular articulated stools forming part of the leg footings to allow cocking of the skid bases and legs, and quickly attachable and detachable sectional tracks for the barge, and guides to keep the footings on the barge tracks. Besides conceiving of the the herein disclosed method, including recognizing the need for the elevators and insisting on their inclusion as part of the system, the present applicant for patent worked out the first method for ballasting of the barge, and worked out the slab layout, and the yard layout, the elevations and inclinations of the slab, gang planks and barge. Joint seals are disclosed by both Air Barge and Aero-Go, but a hot beeswax final sealer was suggested by Fred Tepera of Brown & Root, Inc.

The valving, piping, and controls to be employed for delivering fluid to inflate the fluid bearings, to activate the fluid bearings, and to actuate the fluid elevators, was worked out by collaboration between various personnel at Aero-Go and Brown & Root, Inc., and their employed consultants.

Although much of the hardware, apparatus, structures, and controls have been improved and detailed as above set forth, the basic means for carrying out the subject method in principle were already in existence at the time of the invention, as previously indicated.

BRIEF DESCRIPTION OF THE DRAWINGS

FIG. 1 is a pictorial view of an offshore platform in accordance with the prior art;

FIG. 2 is a pictorial view of a jacket template being towed to location in accordance with the prior art;

FIGS. 10–13 are diagrams used in working out the ballasting of the barge;

FIG. 15 is a vertical section through the end of the barge and the dock head;

FIG. 16 is a fragmentary end view of the barge and one of the rests at the dock head;

DESCRIPTION OF PREFERRED EMBODIMENT

Figure 3:
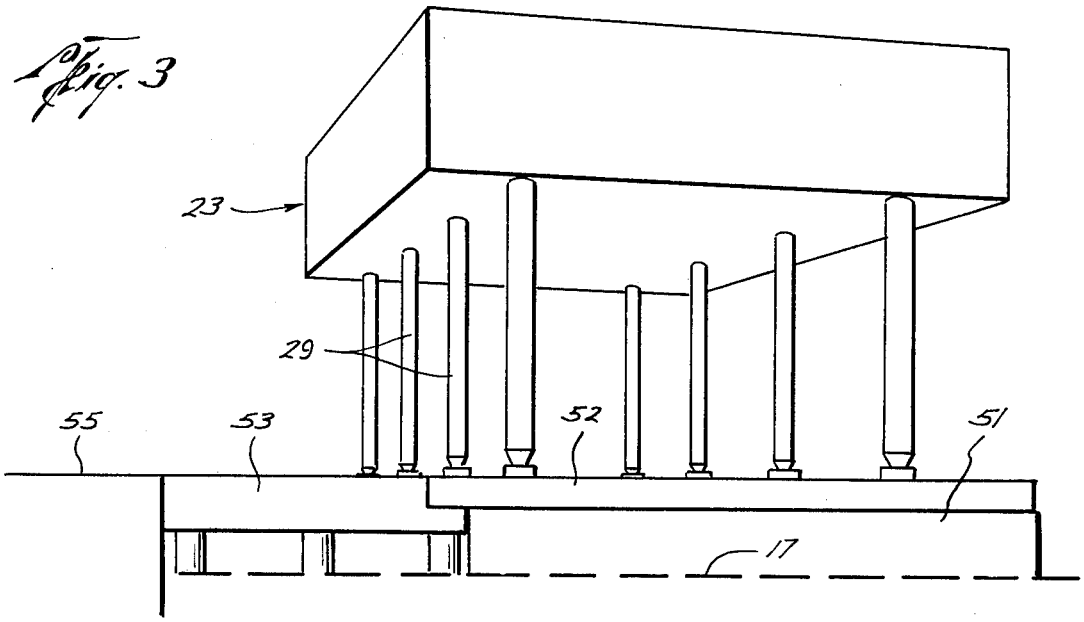
FIG. 3 is a pictorial view of a deck section skidded laterally onto a barge in accordance with the prior art.

Referring now to FIG. 1 there is shown an offshore drilling platform comprising a jacket template 11 through which piles 13 are driven, forming a tower 15. The tower is largely below the water surface 17 and is firmly anchored to the earth 19 below the sea floor 21. If desired, the pipes 22, forming the vertical columns of the tower, can be filled with cement around the piles 13. Atop the toweris deck section 23 including upper and lower decks 25, 27 and a plurality, typically eight, of legs 29. The bottom ends of the legs are secured to the top of the tower. The upper ends of the legs are integrated with, i.e. connected to and supported by, the deck.

Referring now to FIG. 2 there is shown a jacket template 11 on a barge 31 being towed and pushed by tugboats 33, 35, 37. The template comprises a plurality of battered near vertical pipes 22 and a diagonal and transverse cross bracing 41, 43. The upper ends of the pipes are open forming sockets 45 to receive stabbing points on the lower ends of the deck section legs 29 (FIG. 1) when the platform is assembled.

Figure 4:
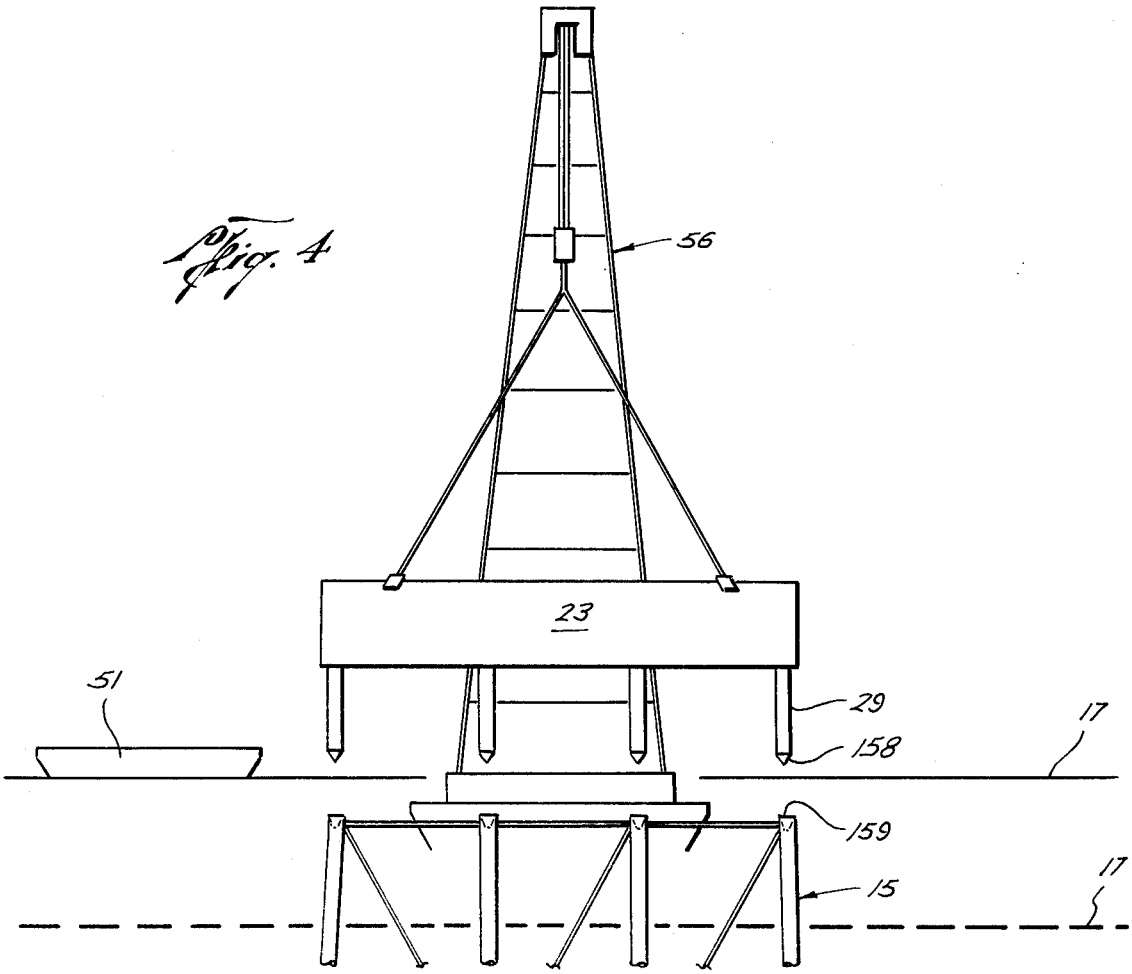
FIG. 4 is a pictorial view of a deck section which, having been lifted from a barge, is about to be set on a tower provided by a jacket template which has previously been placed in position and anchored with piling.

Referring to FIG. 3 there is shown a deck section 23 on skids 52 on a barge 51 to which barge the deck section has just been transferred by skidding it laterally over bridge 53 from fabrication yard 55. The barge is then towed to a location to which the jacket template has previously been towed and anchored with piling to form tower 15. FIG. 4 illustrates the use of a marine crane 56 for transferring a deck section from barge 51 to tower 15 for assembly therewith to form the complete platform of FIG. 1.

Figure 5:
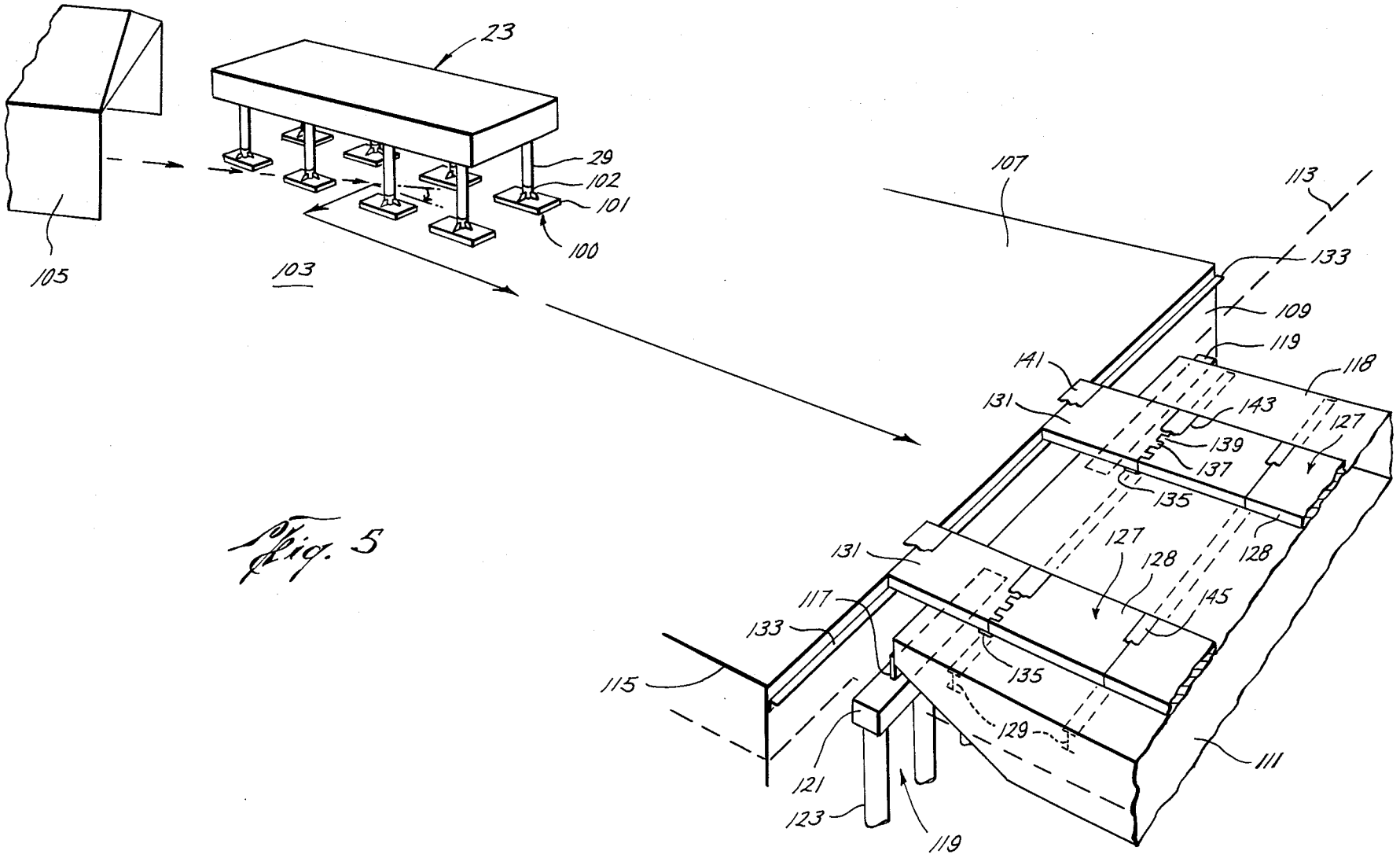
FIG. 5 is a pictorial view of a marine fabricating yard showing structures and apparatus employed in carrying out the method of the invention.

FIGS. 1–4 are illustrative of the previously known art of offshore platform construction and assembly methods. FIG. 5 illustrates the method of the invention. As there shown a deck section 23 is carried by footings 100 beneath each of the eight legs. The footings each include a base 101, adapted to receive a fluid bearing, and a stool 102, adapted to receive one of the legs of the deck section. Preferably the stools are articulated, i.e. hinged, to allow canting of the bases relative to the legs. The footings will be described in further detail hereinafter.

The section 23 is shown disposed on the reinforced concrete floor 103 of a fabrication building 105. Adjacent the floor 103 is a reinforced concrete slab 107, forming a continuation of the floor outside of the building and providing a roadway to dockhead 109.

Adjacent the dock head is one end of elongated barge 111. The barge is in part floating in the water 113 in slip 115. The end of the barge, the stern, adjacent the dock head is provided with any suitable support means, such as, preferably a number of plates 117 welded to the stern of the barge, below the level of its deck 118. The barge is shown as ballasted so that some of the barge weight is transferred by plates 117 to a suitable bearing means such as, preferably, a pair of rests 119. Each of the rests 119 preferably takes the form of a steel box girder filled with concrete forming cap 121 atop a number of piles 123.

On the deck 118 of barge 111, there is provided a pair of tracks 127 adapted to receive fluid bearings. The tracks span the transverse beams 129 that extend below the barge deck. Preferably, the tracks each comprise a number of sections 128 removably secured to the deck, each section spanning several of the beams 129.

A pair of gang planks 131 having top surfaces adapted to receive fluid bearings, connect the tracks 127 with slab 107. Preferably the gang planks are anchored to the dock head, being received in steps 133 cut therein, and slidably supported on steps 135 formed at the ends of tracks 127. Inter-leaving fingers 137, 139 on the barge track sections adjacent the gang planks and on the end of the gang planks nearest the barge prevent relative lateral movement of the gang planks and tracks while still allowing axial sliding therebetween. Any suitable seal means, preferably such as plates 141, 143, 145 together with seal strips and sealing wax (beeswax) is used at the junctures of the gang planks with the dockhead and barge tracks and at the junctures of the barge tracks sections, as will be described in more detail hereinafter.

According to the invention, the grade of the fabrication yard and the slab leading from the yard to the dockhead is very slight, e.g. 0.3% in the yard and 0.1% for the slab, positive or negative, just enough to drain off water within a reasonable length of time. If the grade is too great, the deck section when elevated on the fluid bearings will require too much restraining force to prevent it from sliding off to the side of the yard to slab. A lateral force of approximately 1/1000 of the load weight will move a load supported on fluid bearings on a level surface. Since the lateral force is weight times the sine of the grade angle, it is apparent that any grade angle in excess of arc sine 0.001=0.05 degrees is apt to cause downgrade sliding absent restraint.

Figure 6:
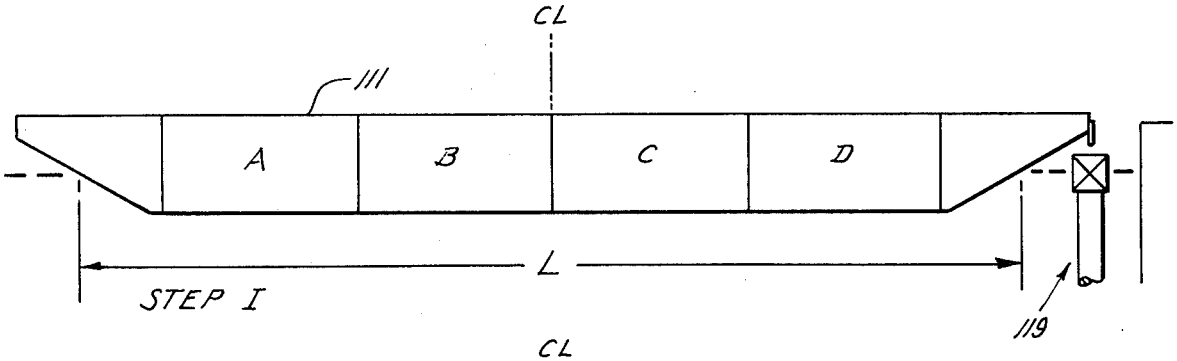
FIGS. 6–9 are schematic side views of the barge and dockhead illustrating the various steps in ballasting of the barge.
Figure 7:
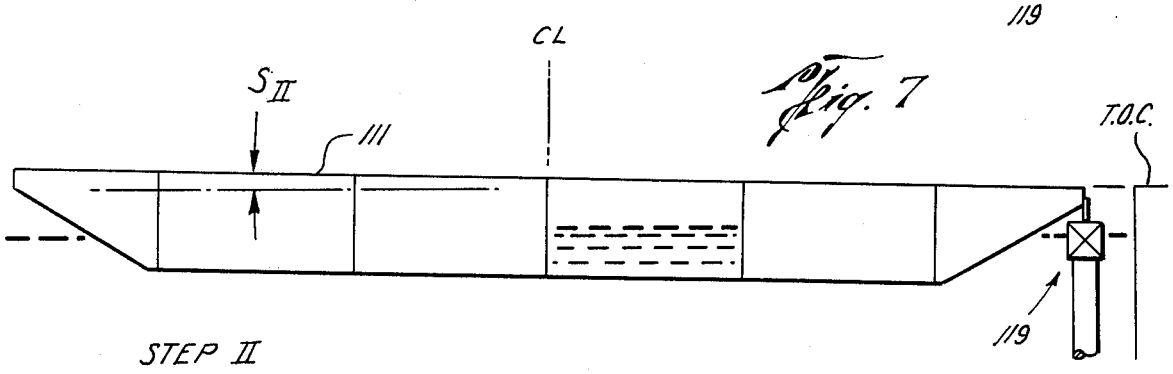
Figure 8:
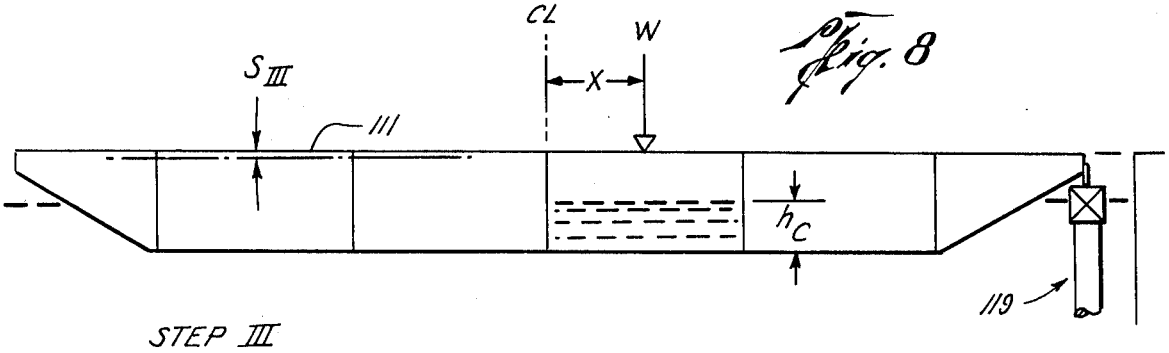
Figure 9:
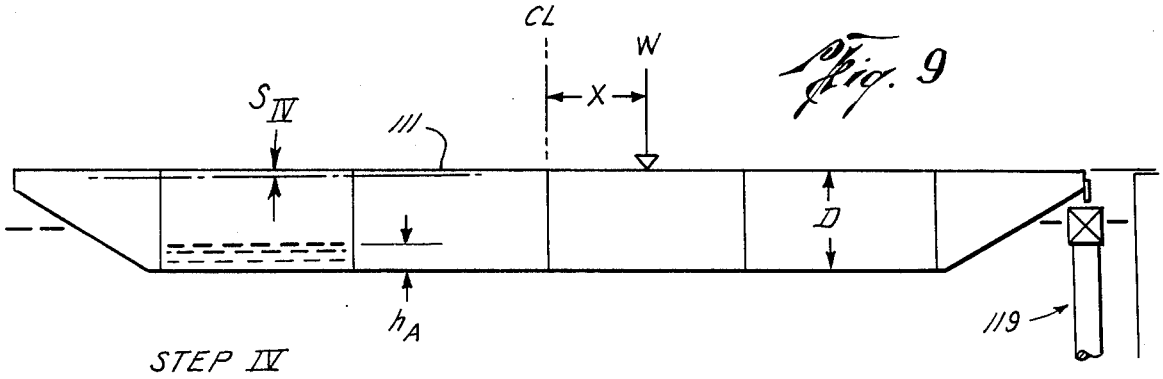

A feature of the invention is maintenance of minimum grade on the barge as the deck section is loaded on the barge. Referring now to FIGS. 6–9, there are shown steps of the method according to the invention. FIG. 6 shows the barge 111 unballasted, or at least level. The stern of the barge has been brought in so that the support means (plate 117, see FIG. 4) is over the rest 119. Then, as shown in FIG. 7, the barge is ballasted until its stern bears on rest 119. The deck section, represented in FIGS. 8 and 9 by load W, is then moved out onto the barge, as illustrated by FIG. 8. Ballast is then shifted until the stern of the barge is free of the rest 119 and the barge is level or otherwise trimmed as desired.

It is to be noted that according to the preferred embodiment of the invention, no ballasting or shifting of ballast is required during transfer of load W from dockhead to barge. As an example of the factors involved in achieving this result, and at the same time maintaining minimum grade on the barge, one may consider the following problem; referring to the parameters shown in FIGS. 6–9.:

PROBLEM

1. Determine centerline, CL; draft, d; and trim, S, for each step.
2. Determine minimum $y$ required for load W at distance $x$.
3. Find difference in elevation between top of concrete, T.O.C., and water level. Water level varies with tide and time.

To solve the problem, reference will be made to various algebraic quantities defined as follows:

DEFINITIONS

Let $W$ = weight moved onto barge
$x$ = distance of W aft of CL in final position
$y$ = minimum clearance required between T.O.C. and barge deck when barge is dry and level
$S$ = slope of deck (ft./ft.) (bow high positive).
Let $L$ = length of water plane cut by barge
$B$ = width of barge
$D$ = depth of barge
$R_p$ = reaction of pivot (stern of barge)
$W_E$ = empty weight of barge
$d_E$ = empty draft of barge
$W_A$ = weight of water in tank A
$W_B$ = weight of water in tank B
$W_C$ = weight of water in tank C
$W_D$ = weight of water in tank D
$F_B$ = vertical bouyant force acting through barge CL $M_s$ = moment of water on barge resulting from slope S $K$ = unit weight of water $h_A$ = depth of water in tank A $h_C$ = depth of water in tank C $\Delta E$ = distance T.O.C. is above barge water line.

Assume a barge 16 feet deep.

The first step in the solution of the problem is to write the general equation for the barge, having reference to the force and moment diagram of FIG. 10.

The equations are a. Sum Vertical Forces = 0, so that $$W_E + W + W_A + W_B + W_C + W_D = F_B + R_p \quad (1)$$

b. Sum of the moments about CL = 0 (counter clockwise moments are considered positive), so that $$\frac{3bW_A}{2} + \frac{bW_B}{2} - \frac{bW_C}{2} - \frac{3bW_D}{2} - xW + \frac{5bR_p}{2} + M_s = 0 \quad (2)$$

Next, with reference to the diagram of FIG. 11, we write the Equations for $F_B$ and $M_s$ (neglecting rakes at ends). Using the above definitions, Archimedes principle may be expressed as :

$$F_B = KLBd \ldots \quad (3)$$

The Resultant, $R_s$, of the pressure triangle (acts $\frac{1}{3}$ the distance from the big end) may be expressed as $$R_s = \frac{(1)(1)}{(2)(2)} S \frac{L}{2} BK = \frac{1}{8} SL^2BK \quad (4)$$

The moment, $M_s$, due to the couple of $R_{s\uparrow}$ *and* $Rs\downarrow$ *is:*

$$M_s = \frac{2L}{3} R_s = \frac{1}{12} SL^3BK \quad (5)$$

Using equation (3) in equation (1):

$$W_E + W + W_A + W_B + W_C + W_D = KLBd + R_p$$

Therefore:

$$d = \frac{1}{KLB} (W_E + W + W_A + W_B + W_C + W_D - R_p) \quad (6)$$

Using equation (5) in equation (2) and clearing the fractions:

$$18\, bW_A + 6bW_B - 6bW_C - 18bW_D - 12xW + 30bR_p + SL^3BK = 0$$

Rearranging and solving for S yields:

$$S = \frac{b}{L^3BK} [18 (W_D - W_A) + 6(W_C - W_B) - 30R_p + 12 \frac{x}{b} W] \quad (7)$$

The foregoing equations (1) - (7) are next applied to the condition arising in each of the several steps I - IV illustrated in FIGS. 6 - 9, to compute the barge grade.

By definition, in Step I, the barge is level and the grade or slope should be zero.

STEP I $S = R_p = W_A = W_B = W_C = W_D = W = 0$

Substituting these values into equations (6) and (7) above:

$$d = d_E = \frac{1}{KLB} [W_E + 0 + 0 + 0 + 0 + 0 - 0] \quad (6)$$

Therefore:

$$d_E = \frac{W_E}{KLB} \quad (8)$$

And:

$$S = \frac{b}{L^3BK} [18(0 - 0) + 6(0 - 0) - 30(0) + 12 \frac{x}{b} (0)] \quad (7)$$

or s = 0 (check).

In Step II, the barge is ballasted to lower its stern onto the rest at the dockhead, e.g. by ballasting tank C on the stern side of the center line. In Step III, load W is not moved past the midpoint of the barge, really the center of the buoyancy, which is assumed to be at the centerline (CL) of the barge, so as not to create any moment that would lift the stern off its rest. In the example that load is shown only to be moved to the midpoint of tank C of the barge. Then, in Step IV, after the load is anchored, ballast is shifted from tank C to tank A, but the grade is maintained positive (bow high). At this stage of affairs, we then have:

STEP IV $W = W$ $S > 0$ $W_A = W_A$ $W_B = W_C = W_D = R_p = 0$ What is the quantity of ballast to be placed in tank A in Step IV?Using the values immediately above in equations (6) and (7) yields:

$$d = \frac{1}{KLB} [W_E + W + W_A + 0 + 0 + 0 - 0] \quad (9)$$

Therefore:

$$d = d_E + \frac{1}{KLB} [W + W_A] \quad (9)$$

$$S = \frac{b}{L^3BK} [18 (0 - W_A) + 6(0 - 0) - 30(0) + \frac{12 \times W}{b}] \quad (7)$$

Therefore:

$$S = \frac{6b}{L^3BK} [\frac{2 \times W}{b} - 3W_A] \quad (10)$$

For $$S > 0, \frac{2 \times W}{b} > 3W_A, \text{ and} \quad (11)$$

For $W$ = 1000 Tons = 2,000,000 pounds = $2 \times 10^6$ lbs., and $$3W_A < \frac{2 \times W}{b} = \frac{2(1)\,(2 \times 10^6)\text{ lbs.}}{2}$$

$$W_A < 666{,}667 \text{ lbs.}$$

This value of $W_A$, i.e. 666,667 pounds, is the upper limit. Using Archimedes principle with $d = h_A$, the depth of water, $h_A$, in tank A which corresponds to the upper limit value of $W_A$ is:

$$W_A = KbBh_A$$

$$W_A = KbBh_A$$

$$h_A = \frac{W_A}{KbB} = \frac{666{,}667 \text{ lbs.}}{(62.4 \text{ lbs/ft}^3)\,(50 \text{ ft.})\,(75 \text{ ft})}$$

$h_A$ = 2.84 ft. (upper limit to depth of water in tank A)

If it is desired that the bow be 18 inches higher than the stern in Step IV, the depth of water to be maintained in tank A may be calculated as follows. Since the length of the barge is several orders of magnitude greater than 18 inches.

$$S = \frac{\text{Difference in height at bow and stern}}{\text{Length of barge}}$$

$$= \frac{(18 \text{ inches})\,(\text{feet})}{(250 \text{ feet})\,(12 \text{ inches})}$$

$$= 0.006$$

Using equation (10 ) above, $$S = \frac{6b}{L^3BK}\left[\frac{2 \times W}{b} - 3W_A\right].$$

Assume L = 225', x = b/2, W = 1000 tons, then:

$$S = 0.006 = \frac{6(50 \text{ ft.})}{(225 \text{ ft.})^3\,(75 \text{ ft.})\,(62.4 \text{ lbs./ft.}^3)}\left[\frac{2(1)\,(2 \times 10^6 \text{ lbs})}{2} - 3W_A\right]$$

$$0.006 = (5.62)\,(10^{-9})\,[2 \times 10^6 - 3W_A]$$

$$0.00600 = 0.01124 - (5.62)\,(10^9)\,3W_A$$

$$W_A = \frac{(0.005240)\,(10^9)}{(5.62)\,(3)}$$

$W_A$ = 310,794 lbs. (ballast in tank A)

Assuming that the ballast weight is proportional to the depth of water in tank A, then $$h_A = \frac{310{,}794 \text{ lbs.}}{666{,}667 \text{ lbs.}} \times 2.85 \text{ ft.} = 1.33 \text{ ft. (water depth in tank A)}$$

Using equation (9) above:

$$d_{IV} = d_E + (1/KLB)\,(W + W_A)$$

$$d_{IV} = d_E + (1/KLB)\,(2 \times 10^6 \text{lbs.} + 310{,}794 \text{ lbs.})$$

$d_{IV} = d_E$ + 2.19 ft. (barge centerline draft in step IV)
Assuming $d_E$ = 3.00 ft.

Then $d_{IV}$ = 5.19 ft.

Freeboard at CL = 16.00ft. − d = 16.00ft. − 2.19ft. − $d_E$ = 13.81ft. − $d_E$

Again assuming $d_E$ = 3.00 ft., then

Freeboard at CL = 10.81 ft

| | |
|---|---|
| Freeboard at stern = | 13.81 ft. − $d_E$ − (S) (125 ft.) |
| = | 13.81 ft. − $d_E$ − (0.006) (125) ft. |
| = | 13.81 ft. − $d_E$ − 0.750 ft. |
| = | 13.06 ft. − $d_E$ |
| = | 10.06 ft., if $d_{E = 3.00 ft.}$ |

Allow 4 inches=0.33 ft. so that stern can rise above T.O.C. for clearance. Then ΔE, which is distance T.O.C. is above barge water line, is determined as follows:

| | |
|---|---|
| ΔE = | 13.06 ft. − 0.33 ft. − $d_E$ |
| = | 12.73 ft. − $d_E$ |
| = | 9.73, for $d_E$ = 3.00 |

Go back to Step I and calculate *y*. Referring to FIG. 12, it is seen that:

$$y + \Delta E + d_E = 16.00 \text{ ft.}$$

$$y + (12.73 \text{ ft.} - d_E) + d_E = 16.00 \text{ ft.}$$

$y$ = 16.00 ft. − 12.73 ft. = 3.27 ft. (not dependent on $d_E$)

Next let us calculate the ballast for tank C required in step II:

STEP II

Using equation (6), we have:

$$d = d_E + \frac{1}{KLB}\,(0 + 0 + 0 + W_c + 0 - 0) \tag{12}$$

$$d_{II} = d_E + \frac{W_c}{KLB}$$

Using equation (7), we have $$S = \frac{b}{L^3BK}\,[18(0 - 0) + 6(W_c - 0) - 30\,(0) + 0] \tag{13}$$

$$S_{II} = \frac{6bW_c}{L^3BK}$$

Referring now to FIG. 13,

$$\Delta E + 125(S) \text{ ft.} = 16 \text{ ft.} - d \tag{14}$$

$$(12.73 - d_E) + 125\,\frac{6bW_c}{L^3BK} \text{ ft.} = 16 \text{ ft.} - \left(d_E + \frac{W_C}{KLB}\right)$$

$$\frac{W_c(125)\,(6)\,(b)}{L^3BK} + \frac{W_c}{KLB} = 16.00 \text{ ft.} - 12.73 \text{ ft.}$$

$$W_C\left[\frac{(125)\,(6)\,(50)}{(225)^3\,(75)\,(62.4)} + \frac{1}{(62.4)\,(225)\,(75)}\right] = 3.27$$

$$W_C\left[\frac{125 \times 6 \times 50}{(225)^2} + 1\right] = (3.27)\,(225)\,(75)\,(62.4)$$

$$W_C(0.741 + 1) = 3{,}443{,}310$$

The ballast in tank C in step II (and step III) is therefore $W_C$ = 1,977,777 pounds (not a function of $d_E$)

and the barge grade, S, in step II is:

$$S_{II} = \frac{6bW_c}{L^3BK} = \frac{(6)\,(50)\,(1{,}977{,}777)}{(225)^3\,(75)\,(62.4)} = 0.0111$$

Therefore, the bow is 2,78 ft. high and the grade is 1.11% The center line draft of the barge in step II is:

$$d_{II} = d_E + \frac{W_C}{KLB} = d_E + \frac{1{,}977{,}777 \text{ lbs.}}{(62.4 \text{ lbs/ft}^3)\,(225 \text{ ft.})\,(75 \text{ ft.})}$$

$$d_{II} = d_E = 1.88 \text{ ft.}$$

$$d_{II} = 4.88 \text{ ft., for } d_E = 3.00 \text{ ft.}$$

The depth of water, $h_c$, in tank C in step II may be calculated using equation (3) with $d = h_c$:

$$h_c bBK = W_c$$

$$h_c = \frac{1{,}977{,}777 \text{ lbs.}}{(50 \text{ ft.})\,(75 \text{ ft.})\,(62.4 \text{ lbs./ft}^3)} = 8.45 \text{ ft.}$$

Having determined the ballast in tank A for a 0.006 grade in step IV and in tank C for placing the barge stern on the dockhead rest with a grade of 0.0111, we now calculate the resultant grade in step III:

STEP III

Using equation (6) with $W_A = W_B = W_D = 0$, and with $W = 2\times10^6$ pounds and $W_c = 1.978\times10^6$ pounds, we have:

$$d_{III} = d_E + \frac{1}{KLB}(W + 0 + 0 + W_C + 0 - R_p) = d_E + \left(\frac{W + W_c}{KLB} - R_p\right). \quad (15)$$

$$d_{III} = d_E + \frac{(2 + 1.978)\,(10^6) \text{ lbs} - R_p}{(62.4 \text{ lbs./ft.}^3)\,(225 \text{ ft.})\,(75 \text{ ft})}$$

$$d_{III} = d_E + 3.78 \text{ ft.} - \frac{R_p \text{ ft.}}{(62.4)\,(225)\,(65 \text{ lbs.})}$$

Using equation (7), we have:

$$S = \frac{b}{L^3BK}\left[18(0 - 0) + 6(W_C - 0) - 30R_p + 12\frac{x}{b}W\right]$$

$$S_{III} = \frac{b}{L^3BK}\left(6W_C - 30R_p + 12\frac{x}{b}W\right).$$

$$S_{III} = \frac{6b}{L^3BK}\left(W_C - 5R_p + 2\frac{x}{b}W\right).$$

Assume $\frac{x}{b} = \frac{1}{2}$, then:

$$S_{III} = \frac{6(50 \text{ ft.})\,[(2 + 1.978)\,(10^6) - 5R_p]}{(225 \text{ ft.})^3\,(75 \text{ ft.})\,(62.4 \text{ lbs./ft.}^3)}$$

STEP III $$d_{III} = d_E + 3.08'$$

$$S_{III} = 0.00153$$

$$R_p = 0.741 \times 10^6 \text{ lb.}$$

STEP IV $$d_{IV} = d_E + 2.19'$$

$$S_{IV} = 0.006 \text{ (Bow 18 inches higher than stern)}$$

$$W_A = 0.311 \times 10^6 \text{ lb.}$$

$$h_A = 1.33'$$

$$\Delta E = 12.73 - d_E$$

Other ballasting procedures than the one just outlined can be used to achieve the desired result so long as they function to minimize the barge grade initially and finally (and, of course, during loading) and preferably do not require shifting of ballast during loading, i.e. during movement of the deck section from the dockhead onto the barge. For example, after the barge has been brought up to the dockhead or before that, it could be initially ballasted evenly in tanks B and C to maintain trim and lower it until the stern is a predetermined height above the dockhead. Then tank D can be ballasted to cause a rotation, that is, a lowering of the stern to be level with the dockhead. The deck section is then moved onto the barge to a desired location, which could be forward, amidship, or aft, and the barge tank A then ballasted to rotate the barge back to level or other desired attitude, usually tank D being deballasted at the same time, perhaps ending up with uniform water level in all the ballast tanks. The calculations to determine the amount of ballasting for any particular procedure can be made according to the method previously set forth.

Having described the general method of the invention and apparatus useful therewith, and having described the ballasting operation in some detail, attention will next be given to the details of some of the apparatus.

Figure 14:
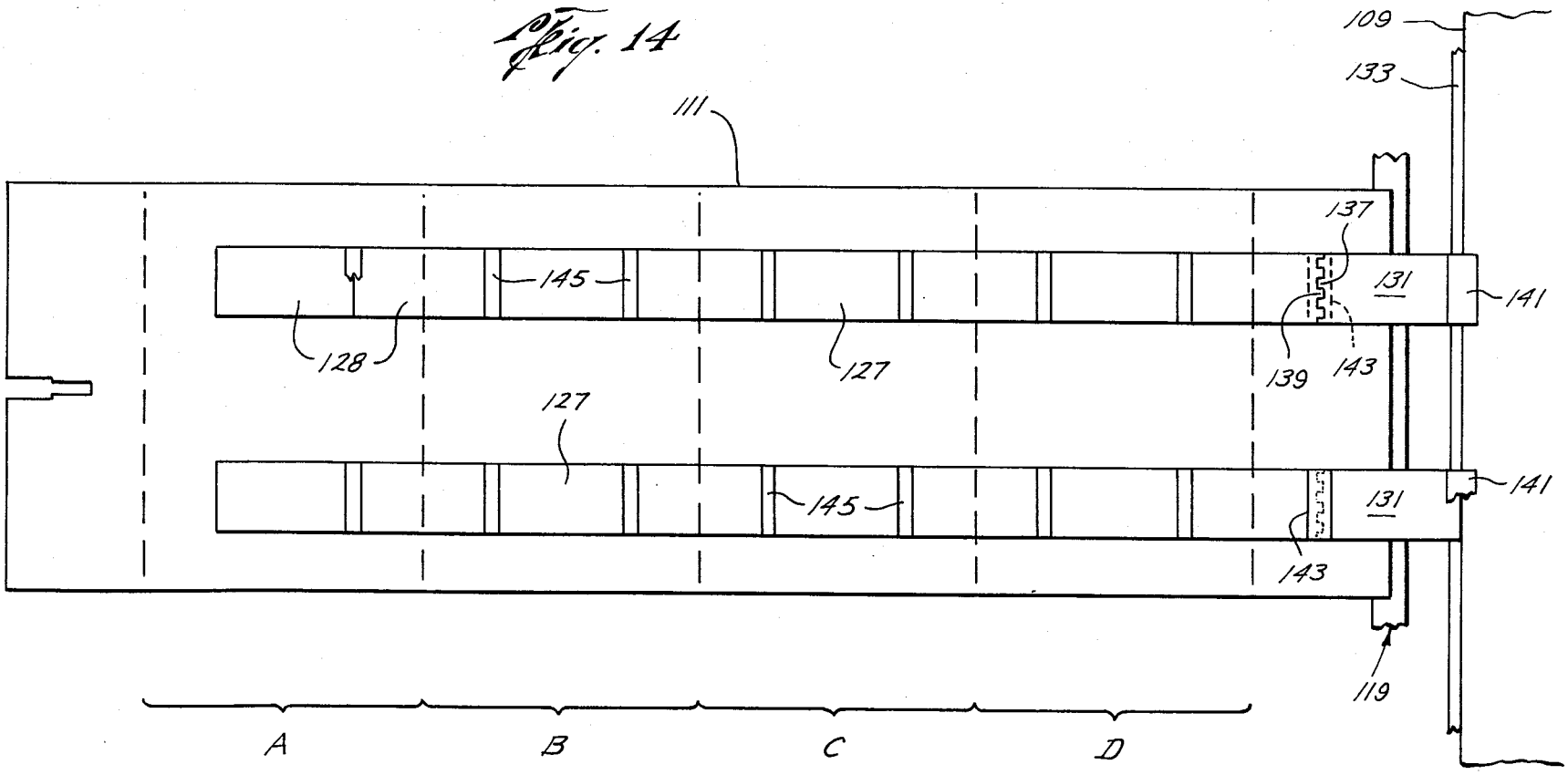
FIG. 14 is a plan view of the barge.

Referring first to FIG.14 there is shown barge 111 to the top of which are secured tracks 127 adapted to receive fluid bearings and to distribute load between the transverse beams of the barge.

Preferably, the tracks are composed of a plurality of sections 127 with plates 145 over the joints and the cracks sealed with sealing wax. However, the precise construction of the tracks does not form part of the invention claimed herein, it being sufficient that any tracks adapted for fluid be provided on the barge.

In FIG. 14, the several ballast tanks are marked A, B, C, D corresponding to the marking of the preceding diagrams of FIGS. 6 - 13. It will be noted that the tracks run lengthwise of the barge and cross the tanks, or at least the ones adjacent the stern of the barge, depending on where the deck section is ultimately to be placed.

Two gangplanks 131 connect the tracks to the dockhead 109. The dockends of the gangplanks rest on step 133 and are secured thereto by any suitable means (not shown) e.g. wedges engaging ears on the gangplank and U brackets on the dockhead, the wedging action compressing a resilient seal strip placed between the gangplank and dockhead. (See also FIG. 15). Preferably, the ends of the last track sections and of gangplanks adjoined therewith are provided with interleaving fingers 139, 137 to prevent lateral shifting while allowing other movement. The juncture is sealed by plate 143 (See FIG. 15), and in similar fashion the juncture of the gangplanks with the dockhead is sealed by plate 141. As shown in FIG. 15, each of these plates preferably includes a downturned flange fitting in a correlative slot in the track of dockhead and being sealed therein with sealing wax. Although these details represent preferred construction, they do not form part of the invention claimed herein since any gangplank adapted for fluid bearings is suitable.

Figure 17:
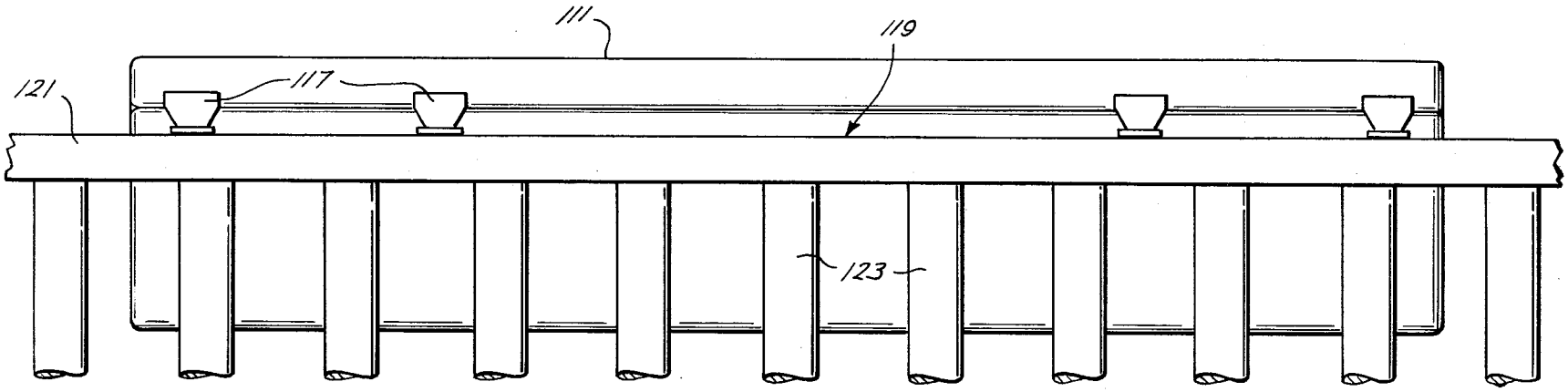
FIG. 17 is a view similar to FIG. 16 showing the entire end of the barge and a modified form of the rest extending the full width of the barge.
Figure 18:
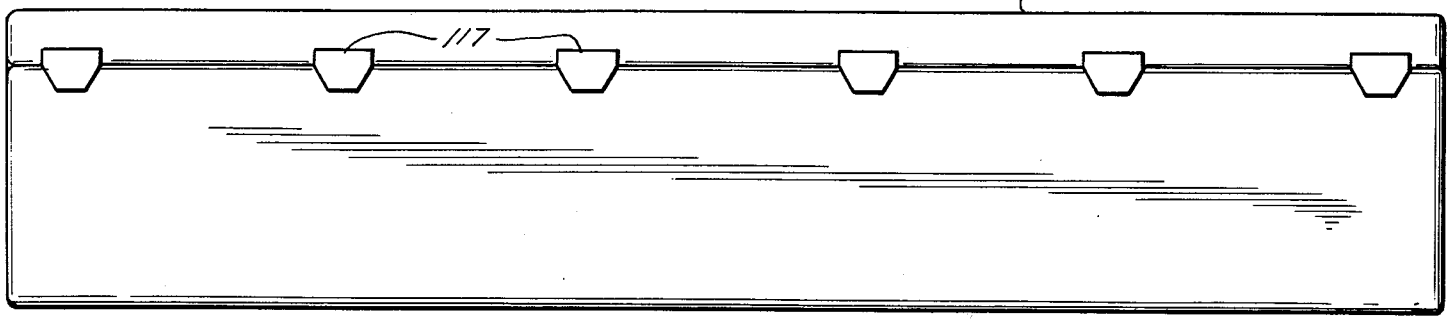
FIG. 18 is a view similar to FIG. 17 showing only the barge but modified by the addition of more support plates for heavier loads.

Referring now to FIGS. 16 and 17, as well as to FIG. 14, there is shown the details of the support plates 117 and the rest 119. FIG. 18 shows a modified arrangement adapted for heavier loads, up to 1650 tons, as compared to up to 1100 Tons in the FIG. 17 embodiment. In the FIG. 18 modification, six plates 117 are provided along the end of the barge 111 whereas in the FIG. 17 embodiment four plates 117 disposed in two groups adjacent each side of the barge are used. As shown in FIG. 17, the rest 119 comprises a plurality of piles 123 supporting cap beam 121. Although the support and rest just described illustrate preferred apparatus, their details do not form part of the invention claimed herein, since any suitable support on the barge and at the dockhead can be used. Rest 119 can be divided into two parts, as shown in FIG. 5.

Figure 19:
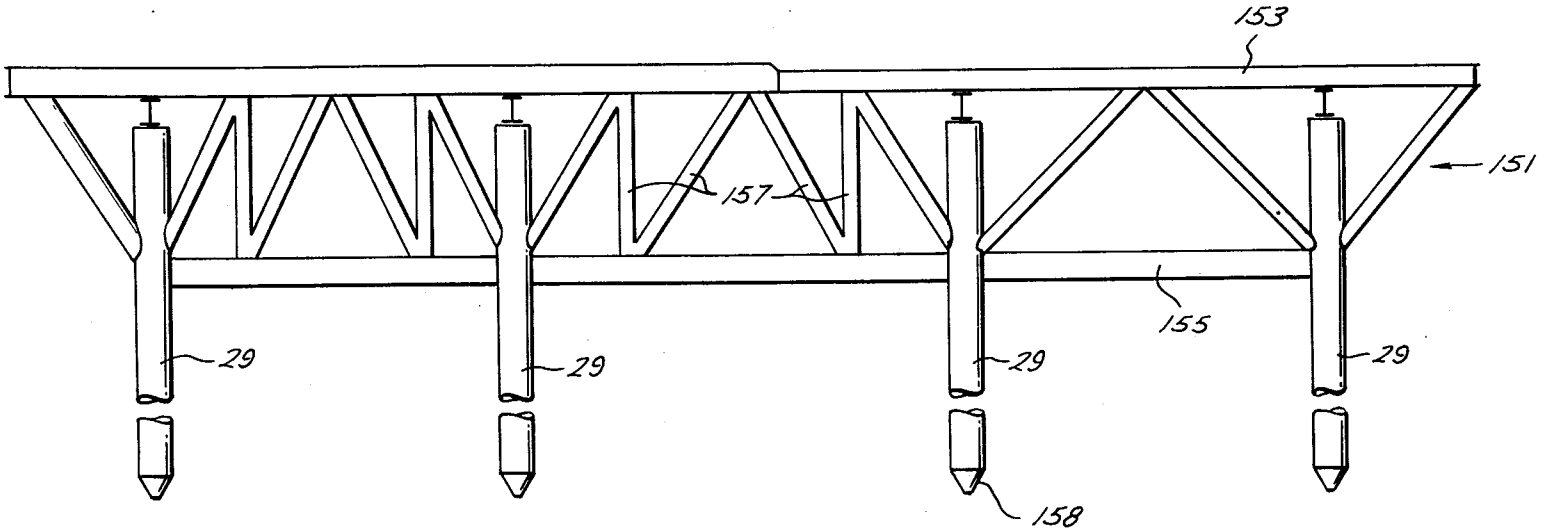
FIG. 19 is an elevation of one of the longitudinal trusses of the deck section.

Referring next to FIG. 19, there is a part of the framework of the deck section 23 of FIG. 1 according to the prior art. In particular, there is shown one of the two longitudinal trusses 151, comprising upper and lower beams 153, 155, and cross bracing 157. Four cylindrical tubular steel legs 29 extend vertically through the truss and downwardly therefrom. The lower ends of the legs terminate in conical stabbing points 158 to facilitate reception in the sockets 159 (FIG. 4) in the tops of the tower 15. These points can rest on top of the piles 13 driven through the template pipes 22, or they can be provided with other suitable means to support them on the template or they can rest directly on the tops of the pipes of the template in a manner similar to that hereinafter described with respect to stools used in conjunction with the fluid bearings.

Figure 22:
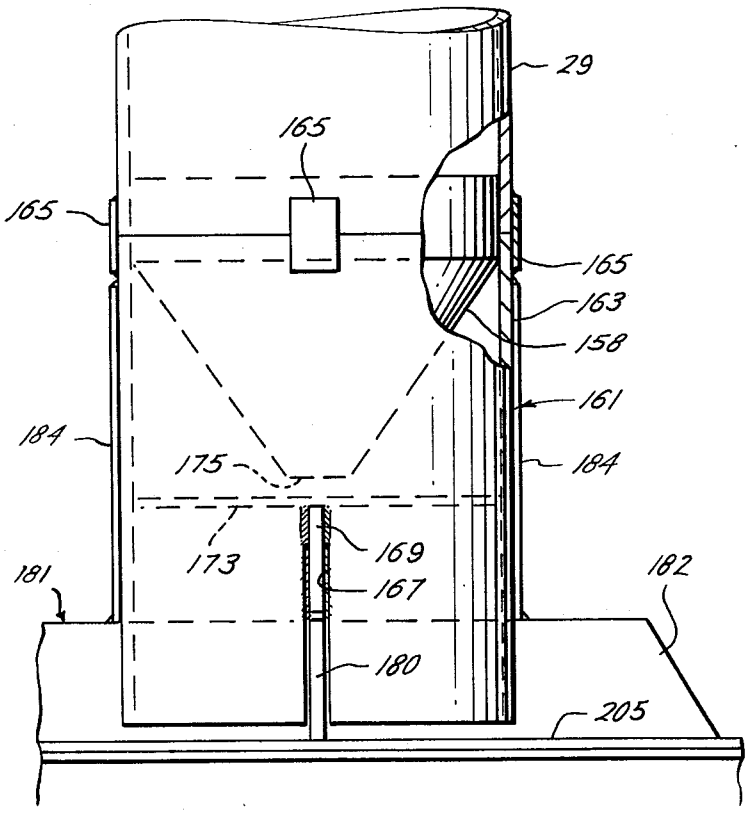
FIGS. 20, 21 and 22 are a plan, vertical section, and side elevation respectively of one of the stools forming part of each footing used to support the deck section legs.
Figure 20:
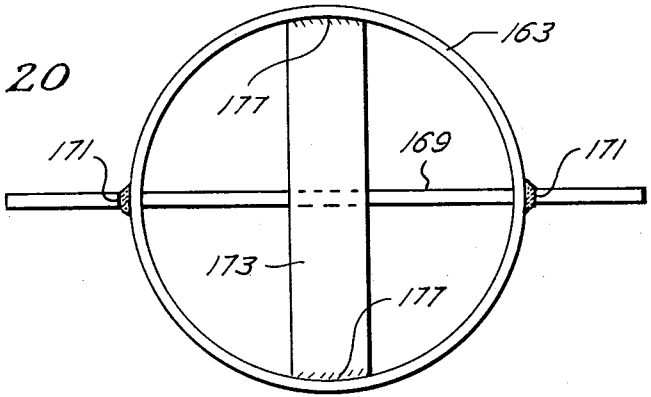
Figure 21:
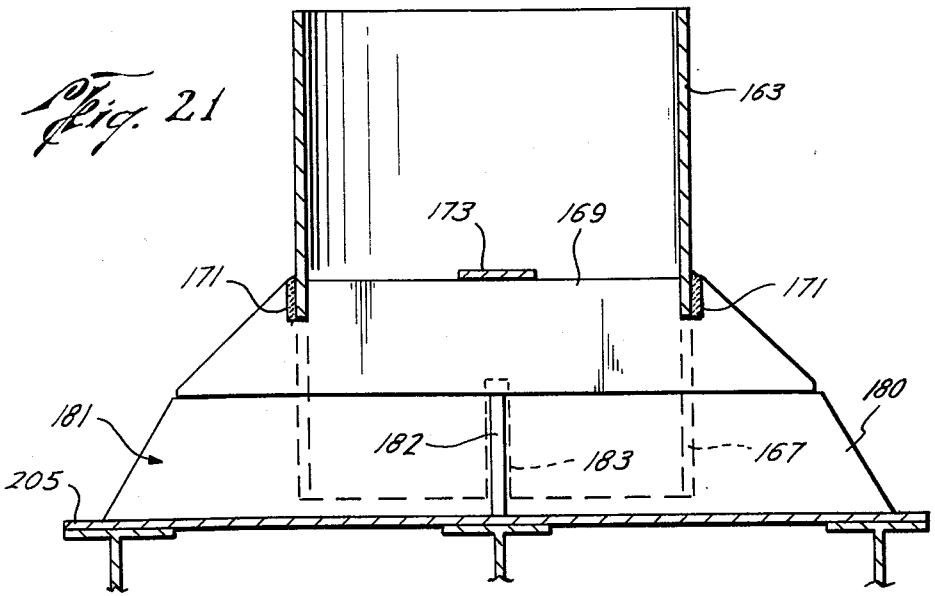

Referring now to FIGS. 20–22, there is shown a suitable flexible stool for mounting one of the deck section legs on a base to effect the method of the invention. The particular structural details of the flexible stool form no part of the invention herein claimed but represent a preferred form of apparatus for carrying out the method of the invention. As best shown in FIG. 22, each stool 161 comprises a short length of pipe or spool 163, of the same inner and outer diameter as the pipe of leg 29, providing a socket similar to socket 159 (FIG. 4) adapted to receive stabbing point 158. Four steel lugs 165 welded to the leg 29 and spool 163 at positions 90 degrees apart provide an overload releasable connection between the leg and stool. The bottom of spool 163 is slotted at 167 to fit over the top of plate 169 (FIGS. 20, 21), the latter also being slotted at 171 (FIGS. 20, 21) to receive the spool. Spool 163 is welded to plate 169 to provide a rigid transverse knife edge extending transverse to the length of the deck section and its path of travel when moving from the dock head onto the barge. A steel strip 173 extends perpendicularly across the top of plate 169 spaced below the tip 175 or point 158. The strip is welded to the spool at its ends as shown at 177. Strip 173 provides internal bracing for the slotted lower end of spool 163 and can be omitted if desired.

The lower edge of plate 169 rests on transverse plate 180 of a cross shaped support or carrier 181, the slots 167 of the spool passing over plate 180 being wider than the plate so as to provide a certain amount of clearance and the spool being additionally slotted on each side at 183 to receive the longitudinal plate 182 of the carrier 181. Plate 169 is free to rock on plate 182, forming a hinge, the clearance between the sides of slots 167 and plate 180 and also the clearance between the tops of slots 183 and the tops of plate 180 defining the amount of rocking that can occur.

Further in accordance with the method of the invention, the rocking about the transverse axes provided by the junctures of plates 169 and 182 is resiliently restrained. This can be accomplished by providing steel retainer strips 184, these being welded at their upper ends to the spool and at their lower ends to plate 182. When plate 169 rocks relative to plate 182, one strip 184 stretches a little and the other buckles slightly.

The articulated stool just described forms part of each of the footings for the deck section legs, the footings being adapted to receive, hydraulic jacks and fluid bearings for elevating the deck section and allowing it to be floated easily to the dock head and onto the barge.

Figure 23:
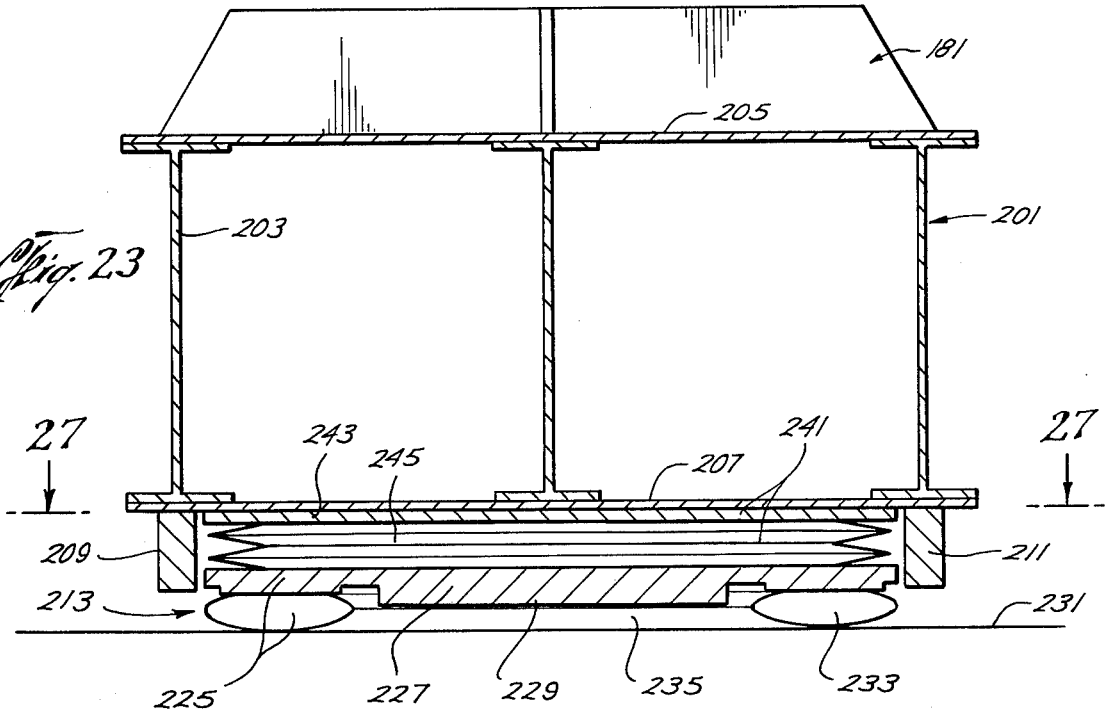
FIG. 23 is an end view of one of the footings with a fluid transport unit (bearing and elevator) thereunder.

Referring now to FIG. 23, each footing further comprises a load distributing base 201 comprising a plurality of I-beams 203 welded to top and bottom plates 205, 207 forming a box like structure. The previously described stool of each footing rests on top of the plate 205 of one of the bases. Beneath the bottom plate 207 of the base are secured wood beams 209, 211 providing skids supporting the base. In emergencies the deck section can be moved by exerting enough lateral force to slide the skids over the concrete slab. However, it is intended that ordinarily one or more fluid transport units 213, each comprising a pneumatic or hydraulic jack and pneumatic bearing, will be moved under each base between the skids, and the barge will be elevated with the jacks and then floated on the bearings preparatory to lateral movement.

Figure 24:
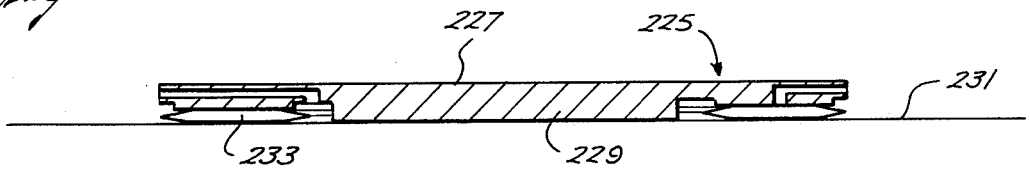
FIGS. 24–26 are schematic views illustrating various stages in the operation of one of the fluid bearings.
Figure 25:
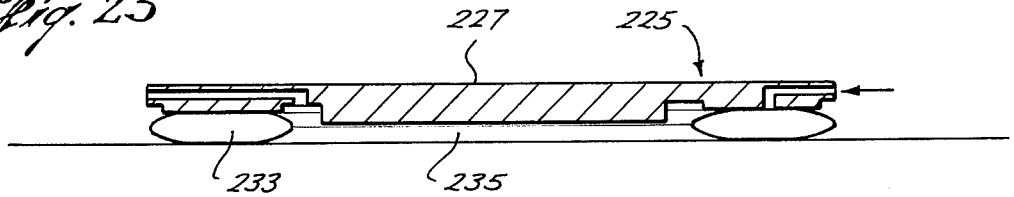
Figure 26:
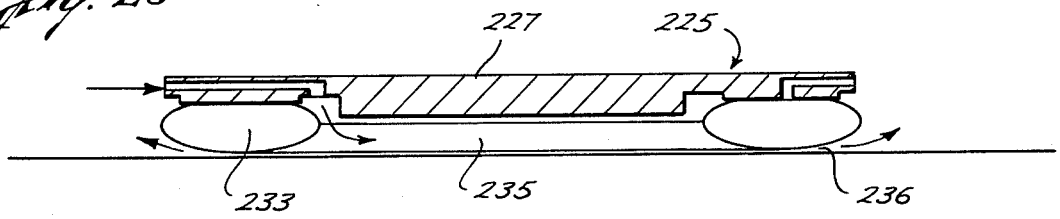

Referring now to FIGS. 24–26 there is shown schematically in various operating conditions a fluid bearing suitable for use in the fluid transport unit. Several fluid bearings may be used together in one transport unit. Each bearing includes a body 227 which receives the weight of the load under which the bearing is placed. When the bearing is not activated, as shown in FIG. 24, the load on the bearing is transferred through bearing pad 229 to the part 231 of the slab on which the bearing rests. Introduction of fluid to the bearing, i.e. to the inflatable flexible annular bag 233 (of which there may be one or more for each bearing) and the interior spaced therewithin, elevates the pad and the load as shown in FIG. 25. When the pressure is raised so that the total upward force exerted by the fluid exceeds the downward force on the body 227, composed of its weight, the load, and atmospheric force, the body floats, the bag 233 leaving the slab, as shown in FIG. 26. The body 227 rises until the leakage of fluid from the interior spaced 235 past the underside of the bag at 236 relieves the fluid pressure sufficiently to effect a balance, the body continuing to float but not rising.

As indicated above, the fluid bearing itself functions also as an elevator. However it is preferred to mount a plain fluid elevator on top of each bearing to form a fluid transport unit to permit a greater height adjustment and to allow height adjustment independent of the activation of the fluid bearing. As shown schematically in FIGS. 23 and 27 such a unit includes a body 243 and a plurality, e.g. two, of flexible bellows 245, which rest on top of the body 227 of each fluid bearing.

Figure 27:
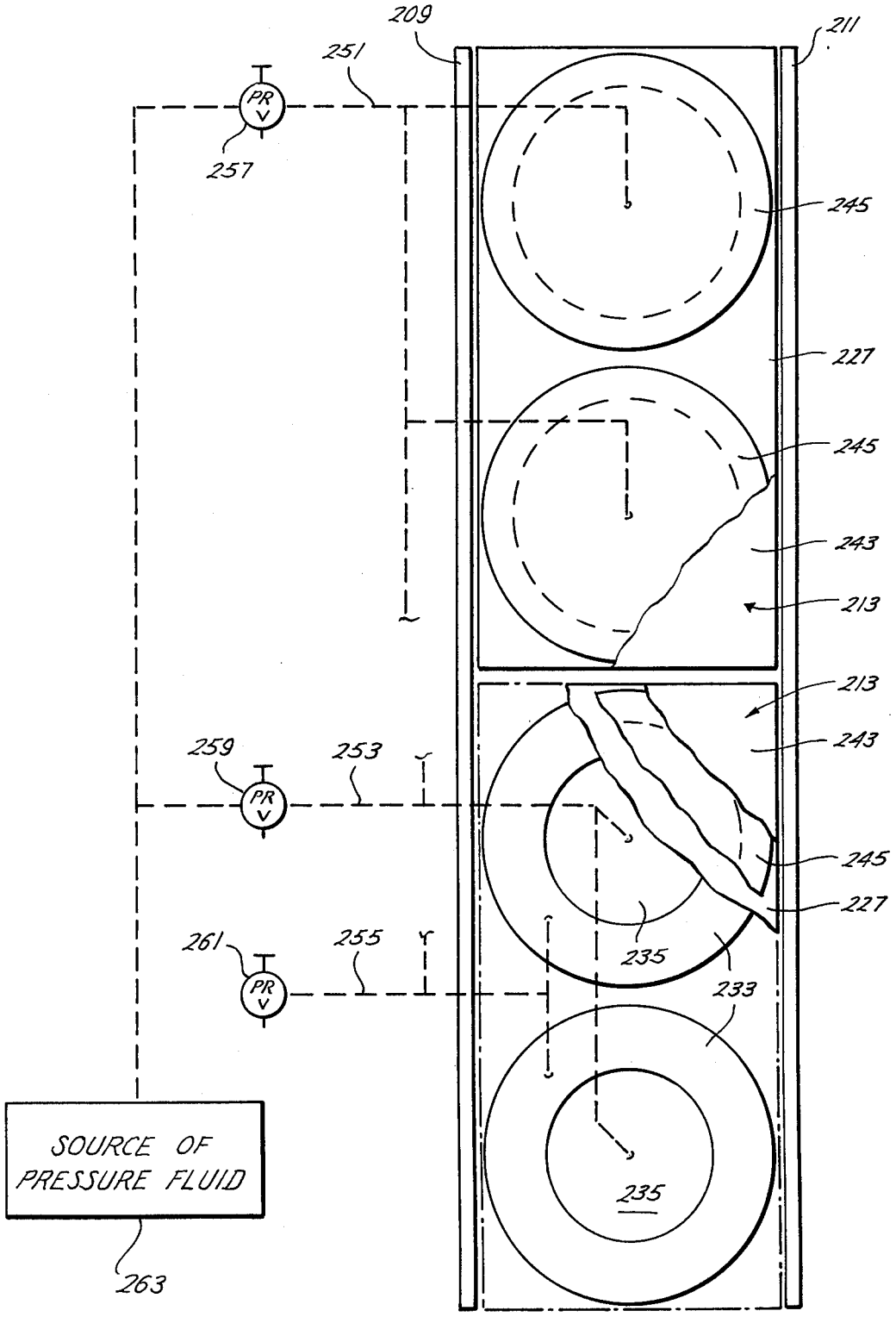
FIG. 27 is a plan view, partially in section, of a pair of fluid transport unit and associated footing and fluid supply lines.

Referring further to FIG. 27 there is shown a preferred disposition of two fluid transport units 213 between the skids 209 and 211 of one footing. Each unit includes two bags 233 and two bellows 245. Preferably the fluid supply system for the fluid transport units will provide for three independently pressure regulated fluid supply lines such as 251, 253, 255 for each unit, one line supplying all of the bellows 245, a second supplying the bags 233, and a third line supplying the interior spaces 235. The three lines for each fluid transport unit may be independently pressure controlled as by means of adjustable regulators 257, 259, 261, or the lines for the units under each deck section footing may be ganged or the lines for the units under several footings may be ganged together as desired. They are fed from a suitable source of pressure fluid 263, e.g. an air compressor or hydraulic pump.

When it is desired to move a transport unit into position under a footing or to remove same, the fluid bearing can be activated while the fluid jack is left in its lowest position so as to give the unit an overall height less than that of the skids. If desired, the transport units can be provided with casters for moving them about when unloaded, but the details of such construction do not form part of the present invention.

In carrying out the method of the invention, as set forth hereinabove and in the appended claims, the loads carried on the several footings and the fluid transport units thereunder can be equalized or otherwise distributed as desired by varying the elevations of the several fluid jacks. If the load on a particular unit is high, the pressure in the fluid bearing interior space 235 must be high in order to float the load. If the capacity of the unit is exceeded, the load will not be floated and the bearing pads will remain on the slab. To reduce the load it is only necessary to lower the fluid jack above the bearing or elevate those of the other bearings.

Once the desired load distribution has been achieved the automatic pressure regulators will tend to maintain such distribution. If during the movement of the deck section a particular footing encounters a place higher than the general plane of the slab (or barge tracks) the height of the spaces 236 between the slab and the bags of the transport unit under the footing will be reduced tending to increase the pressure in the interior spaces 235. This will momentarily tend to lift the footing and increase its loading, but automatic pressure regulation will reduce the rate of fluid flow to the interior space until the pressure drops to its initial value. However the bags will be closer to the slab, perhaps even scraping. To avoid possible damage to the bags, the fluid jacks under the footing can be lowered to accomodate for the high place in the slab.

The above discussion relative to high places in the slab is equally applicable to the situation that exists when the deck section is partly on the barge. In this situation, due to the difference in direction of slope of the slab and barge, it is inevitable that the distances measured along the leg axes from the deck section to the portions of the slab or track under the legs will be different.

By adjusting the fluid transport units initially to take desired loads and by maintaining constant the prescribed pressures in the interior spaces of the fluid bearings during movement of the deck section and by making such adjustment in the fluid jacks as is required to avoid scraping and ground outs during movement of the deck section, the loads of the deck section trusses and legs will not exceed the limits of the deck section even though it has several legs under each truss and is loaded parallel to the lengths of the trusses, i.e. endwise onto the barge.

Broadly the method of the invention contemplates quickly and safely floating a deck section, especially one having several legs per truss, from a fabricating yard out to a slab adjacent a dock head and thence endwise onto a barge without imposing excessive stresses on the deck section. Important steps in various stages of the method are the ballasting of the barge to ground one end and prepare it to accept load without need for ballasting during loading, and the floating of the deck section at minimum inclination on slab and barge tracks, the load distribution on the deck section being maintained as desired during transport of the deck section by regulation of the pressure fluid bearings and adjustment of the height of the fluid jacks as required. By allowing the footings between the legs of the deck section and the fluid transport units to flex during transport, excessive bending moments on the legs and footing, especially during the stage of the section being partly on the barge and partly on the slab, are avoided.

While a preferred embodiment of the method of the invention and apparatus suitable for carrying out the method have been shown and described, many modifications thereof will occur to one skilled in the art without departing from the spirit of the invention.

Some of the possible variations of the method have already been mentioned. For example, the fluid used for the transport units may be air or water. Water is the preferred form of fluid because of its high ready availability at low cost and its relative high viscosity and slow response compared to air and its natural lubricating properties and low environment impact.

Other liquids or gases could be used but are not preferred because of such factors as cost and fire hazard (hydrocarbon fluids). The pressure of the fluids applied to the elevators and bearings may be manually controlled or automatically controlled and manually adjusted, e.g. as shown in FIG. 27. Various expedients known in the art may be used to effect the adjustments, e.g. by remote control. The fluid supplies for all transport units under the four legs on one side of the deck section could be ganged together, as could those under the four legs under the other side of the deck section, since as pointed out in the description of the prior art if all legs on each side go up or down together there is no problem. It is also to be noted that separate control of the fluids supplied to the annular bags 233 and the interior spaces 235 is not necessary, since these pressures are preferably maintained equal.

The location of the fabrication building relative to the dock head can be varied. As shown in FIG. 5 the deck section is intended to be moved lengthwise out of the fabrication building and then turned or rotated to get into the path of travel over the slab to the barge. The fluid transports make it possible to move the deck section sideways or rotate it to any extent or move it in any other direction over the slab as desired.

The particular footings shown can be varied. The lugs 165 (FIG. 22) which secure the footings to the legs of the deck section serve as safety releases in that in case of excessive bending movement thereat they will give way rather than imposing such bending moment on the deck section leg and truss. They are also easily severed with a torch when the deck section is to be placed on a tower, whereby the footings can be removed and returned to the fabrication yard for reuse. However other means can be provided which need not necessarily incorporate these advantageous features. It is desirable, however, in accordance with the invention, to incorporate in the stool some capacity for relative angular movement between the deck section leg and the base of the footing, especially in the direction of expected slab or track elevation change, i.e., about a horizontal axis transverse to the length of the deck section, that being the direction of travel during loading from slab to barge, although the particular form of such articulation or hinge can be varied, but rigidity about axes other than transverse is preferred.

Although removable tracks applied to a standard barge have been illustrated, fluid bearing paths could be built on the barge permanently, or a special barge could be constructed solely for utilization in the method of the invention. In place of gang-planks, other forms of bridge could be employed to provide fluid bearing path from land to vessel.

Other forms of fluid bearings and elevators than those illustrated can be employed. However the nine inch stroke of the elevators is easily achieved with the bellows elevators shown.

Loads can be transferred from barge to barge. Vessels other than barges can be loaded. Vessel grounding and floating and inclination control can be effected by changing the amount or location of the ballast or both.

While it is typical to maintain inclination of the slab forming the floor of the fabrication building to within less than 0.3% and that of the slab outside the building to less than 0.1%, e.g. less than 0.3%, and that of the barge, or more precisely the tracks on the barge, around 2% or less, and the gangplanks very close to level, e.g. less than 0.3% inclination, the inclinations could be varied, a limit for all three, slab, gankplanks, and barge tracks, of perhaps plus or minus one percent being permissible according to the preferred embodiment of the invention.

Variations in the ballasting procedure have already been described. It is to be noted that a feature of the invention is grounding at least that portion of the barge that is adjacent the dock head so that when the load is transferred to the barge there will not be created a discontinuity in elevation which would be difficult for the fluid bearings to pass over.

No specific apparatus is required for moving the deck section about while it is floating. It has been found convenient to use tractors for this purpose. Or the footing can be nudged along with graders or bull dozers or the like. Such a small force is needed to move the deck section that it is not necessary to tie the footings together to distribute the force amongst them, two tractors, one pushing or pulling on a footing at one side and another pushing or pulling at a footing on another side are sufficient to exert the necessary force and torque. Cables can be attached to the deck section and to winches to restrain the deck section against external forces such as gravity and wind. If desired, the tractors can be omitted and the winches and cables used to move the deck section.

I claim:

1. Method of transferring a load to a vessel grounded at a certain land based site comprising the steps of grounding only that portion of the vessel which is adjacent to the site, providing a fluid bearing path on the vessel and extending between the vessel and the site, floating the load along the path onto the vessel on fluid bearings, grounding the load on the vessel, and floating the vessel, the vessel being grounded by ballasting, and prior to load transfer the vessel being ballasted sufficiently to maintain itself level to within plus or minus two percent inclination during load transfer.

2. Method of claim 1 in which there is no change of ballast during load transfer and after the load is grounded to the vessel, the grounded portion of the vessel is floated by changing the ballast.

3. Method of claim 2 in which the vessel is an elongated body and is grounded at one end and the load is an elongated body and is floated onto the barge lengthwise.

4. Method according to claim 2 in which it is the stern of the vessel which is grounded, and in which during transfer of the load the load is not floated forward past the center of buoyancy of the vessel and in which the load is grounded to the vessel prior to the vessel being floated and in which the change in ballast to float the vessel leaves the vessel bow high.

5. Method of transferring a load from land to a marine vessel with elevating fluid bearings comprising the steps of placing a portion of the vessel adjacent the land, ballasting the vessel to ground only the portion of the vessel adjacent the land while leaving another portion floating, to leave the vessel free to change inclination to refloat the vessel upon reballasting after load transfer, and to maintain the inclination of the deck of the vessel relative to the land compatible with the elevating range of the bearings during the movement of the load from land to the vessel, floating the load on the bearings, moving the load onto the vessel, grounding the load on the vessel, and reballasting the vessel to float the vessel.

6. Method of claim 5 in which the load is independently supported at a plurality of positions during transfer and the height of support at each position is adjusted during load transfer to maintain constant load distribution amongst the several positions.

7. Method of claim 5 in which prior to load transfer the vessel is ballasted sufficiently to maintain itself level to within plus or minus two percent inclination during the load transfer.

8. Method of claim 5 in which there is no change of ballast during load transfer and after the load is grounded on the vessel the vessel is floated by changing the ballast.

9. Method of claim 5 in which the vessel is an elongated barge and is grounded at one end and the load is an elongated deck section having several legs at each side and is floated onto the barge lengthwise while supported at each leg.

10. Method of claim 9 in which the vessel is grounded by ballasting and prior to load transfer the vessel is ballasted sufficienty to maintain itself level to within plus or minus 2 percent inclination during load transfer.

11. Method of claim 10 in which there is no change of ballast during load transfer and after the load is grounded on the vessel the vessel is floated by changing the ballast.

12. Method of loading an elongated structure including several top connected, vertical, free ended legs spaced apart along the length of the structure onto an elongated vessel comprising the steps of moving the vessel to adjacent a dock, ballasting the vessel to ground the end of the vessel nearest the dock, placing a gangplank between the dock and the vessel, floating each leg of the structure on an individual fluid bearing, moving the structure lengthwise from the dock over the gangplank onto the vessel, and maintaining desired leg loading during said moving by adjusting the elevation of each leg.

13. Method of loading onto a barge a deck having several top connected, vertical legs extending downward therefrom, said barge being grounded adjacent a dock on below dock supports, said deck legs being disposed atop a slab, there being a gangplank having one end positioned adjacent to the slab and another end positioned adjacent to the barge so that the gangplank forms a load bearing bridge between the slab and the barge comprising:

supporting the deck legs on hinged feet resting on hydraulic elevators on liquid bearings, moving the deck laterally down the slab and up the gangplank and onto the barge, the gangplank having been sealed to the dock and barge, and maintaining desired spacing between the bearings and the slab, the gangplank, and the barge during said moving by adjusting the liquid volume in the elevators.

14. Method of transporting a load comprising:

providing a plurality of supports each having an upper portion and a lower portion relatively movable with respect to each other, each upper portion having a top and each lower portion having a bottom, supporting the load at a plurality of support positions on the tops of said upper portions, floating the bottom of each lower portion, moving the load while the load is supported by the supports whose bottoms are floating, and adjusting the distance between said upper and lower portion of said supports at each position during the moving as required to effect desired load distribution during the moving.

15. Method according to claim 14 in which the load includes elevating the load fluidically and which further comprises:

maintaining each of said bottoms of said lower portions of said plurality of supports in contact with a relatively flat support surface.

16. Method of claim 15 further comprising rockably supporting the load at a plurality of positions for rocking about axes having parallel horizontal components, moving the load in a direction transverse to said horizontal components, and elastically restraining rocking of the load about said axes during the moving of the load.

17. Method of claim 16 wherein the load is floated during movement.

18. Method of claim 17 wherein the height of the supporting is adjusted fluidically during the moving.

19. Method of moving a structure having several aligned top connected vertical legs comprising the steps of mounting each leg on a temporary transport unit receiving base with an articulated stool between the leg and base, moving a fluid transport unit including a fluid elevator atop a fluid bearing under each base, raising the load with the elevators, floating the load with the bearings, and moving the load while maintaining desired load distribution on the legs by adjusting the elevators as needed and allowing the bases to rock relative to the legs.

20. Fluid bearing path comprising an elongated vessel disposed in a body of water, a yard including a slab extending to the water, a non-floating rest adjacent to and located at a distance from the slab at a level below the slab, said vessel having a deck and transverse beams supporting the deck, a pair of parallel lines of track extending longitudinally over the deck of the vessel spanning said transverse beams, said vessel having below deck level support means movable laterally across said rest, while the vessel moves laterally through the body of water, for supporting one end of the vessel on said rest, said support means of said vessel resting on said rest with the length of the vessel extending away from said rest and the other end of said vessel being spaced apart from said rest and floating, a pair of gangplanks extending from said slab to said pair of lines of track on said vessel, one end of each gangplank being supported on the deck of the vessel, and means different from said rest for supporting the other ends of said gangplanks, the last said means being disposed underneath said gangplanks spaced from said one end of the vessel in the direction toward said slab, said slab, gangplanks, and tracks having top surfaces which are planer, imperforate and smooth, adapting them to fluid bearings, said top surfaces having contiguous edges which are substantially co-level, the inclination of the top surfaces of said slab, gangplanks, and tracks being no greater than plus or minus two percent.

* * * * *

UNITED STATES PATENT AND TRADEMARK OFFICE

CERTIFICATE OF CORRECTION

PATENT NO. : 4,055,264

DATED : October 25, 1977

INVENTOR(S) : PHILLIP ANDREW ABBOTT

It is certified that error appears in the above-identified patent and that said Letters Patent are hereby corrected as shown below:

Column 1, line 10, change "cosntruction" to --construction --.

Column 1, line 26, change "thesize" to --the size--.

Column 2, line 3, change "weight" to --weigh--.

Column 2, line 7, change "stabing" to --stabbing--.

Column 3, line 64, delete "and" immediately preceding "the elevations".

Column 4, line 65, change "toweris" to --tower is--.

Column 6, line 11, change "to" to --of--.

Column 7, line 31, change "$R_s$," to $R_s$,--.

Column 8, line 46, change "(9)" to --(6)--.

Column 8, line 64, insert --For-- preceding the equation.

Column 8, line 65, delete "For".

Column 8, line 68, after "and" insert --$\frac{x}{b} = \frac{1}{2}$, then:--.

Column 9, line 11, delete "$W_A$=$KbBh_A$".

Column 11, line 5, insert --Note: 0.0111 x 250 ft. = 2.78 ft.--.

Column 11, line 6, change "2,78 ft." to --2.78 ft.--.

UNITED STATES PATENT AND TRADEMARK OFFICE

CERTIFICATE OF CORRECTION

PATENT NO. : 4,055,264

DATED : October 25, 1977

INVENTOR(S) : PHILLIP ANDREW ABBOTT

It is certified that error appears in the above-identified patent and that said Letters Patent are hereby corrected as shown below:

Column 11, line 60, insert the following:

--$S_{III} = 0.02238 - 0.02813 \times 10^{-6} R_P$ .....(16)

Using compatibility equation (14) from above, $\Delta E + 125\ S_{III} = 16 - d_{III}'$ and inserting equation (16) and $\Delta E = 12.73 - d_E$, we have $$12.73 - d_E + 125\ (0.02238 - 0.02813 \times 10^{-6} R_P)$$
$$= 16 - \left(d_E + 3.78 - \frac{R_P}{(62.4)\ (225)\ (75)}\right).$$

$$12.73 + 2.80 - 3.51^6 \times 10^{-6} R_P = 16.00 - 3.78 + 0.950 \times 10^{-6} R_P$$
$$4.466(10^{-6})\ R_P = 3.310$$
$$R_P = 741{,}155 \quad \text{(case III)}$$

Using equation (15), $d_{III}$ can be calculated as follows:

$$d_{III} = d_E + 3.78' - \frac{741{,}155'}{(62.4)\ (225)\ (75)}$$
$$d_{III} = d_E + 3.78' - 0.70'$$
$$d_{III} = d_E + 3.08', \text{ and therefore}$$

It is certified that error appears in the above-identified patent and that said Letters Patent are hereby corrected as shown below:

$d_{III}$= 6.08 ft. for d = 3.00 ft.

Using equation (16) from above, $S_{III}$ can be calculated as follows:

$$S_{III} = 0.02238 - (0.02813)\ (10^{-6})\ (741,155)$$
$$S_{III} = 0.02238 - 0.02085 = 0.00153$$

It is thus seen that the grade after loading the barge (step III) is still minimal as is desired in accordance with the invention.

Summarizing, for a one thousand ton load and a final placement of the load at a distance of one half a ballast tank to the stern of the barge center line, the distance the barge stern is above the dock head, the center displacements of the barge, the barge grades, the water ballast weight and depth, the rest load, and the distance between the barge water line and the top of the dock head are, in various steps:

UNITED STATES PATENT AND TRADEMARK OFFICE

CERTIFICATE OF CORRECTION

PATENT NO. : 4,055,264

DATED : October 25, 1977

INVENTOR(S) : PHILLIP ANDREW ABBOTT

It is certified that error appears in the above-identified patent and that said Letters Patent are hereby corrected as shown below:

STEP I $y = 3.27'$

STEP II $d_{III} = d_E + 1.88'$ $S_{II} = 0.0111.$ $W_c = 1.98 \times 10^6$ lb.

$h_c = 8.45'$--.

Column 13, line 10, change "of" to --or--.

Column 18, line 21, change "to" to --on--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*